US010274856B2

(12) United States Patent
Nakajima et al.

(10) Patent No.: US 10,274,856 B2
(45) Date of Patent: Apr. 30, 2019

(54) TONER FOR ELECTROPHOTOGRAPHY, IMAGE FORMING METHOD, AND PROCESS CARTRIDGE

(71) Applicants: Hisashi Nakajima, Shizuoka (JP); Kazumi Suzuki, Shizuoka (JP); Masashi Nagayama, Shizuoka (JP); Saori Yamada, Shizuoka (JP); Yoshitaka Yamauchi, Shizuoka (JP); Yu Naito, Shizuoka (JP); Yoshitaka Sekiguchi, Hyogo (JP)

(72) Inventors: Hisashi Nakajima, Shizuoka (JP); Kazumi Suzuki, Shizuoka (JP); Masashi Nagayama, Shizuoka (JP); Saori Yamada, Shizuoka (JP); Yoshitaka Yamauchi, Shizuoka (JP); Yu Naito, Shizuoka (JP); Yoshitaka Sekiguchi, Hyogo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/110,192

(22) PCT Filed: Jan. 6, 2015

(86) PCT No.: PCT/JP2015/050567
§ 371 (c)(1),
(2) Date: Jul. 7, 2016

(87) PCT Pub. No.: WO2015/108005
PCT Pub. Date: Jul. 23, 2015

(65) Prior Publication Data
US 2016/0327884 A1 Nov. 10, 2016

(30) Foreign Application Priority Data
Jan. 17, 2014 (JP) ..... 2014-006454

(51) Int. Cl.
*G03G 9/08* (2006.01)
*G03G 9/087* (2006.01)
(Continued)

(52) U.S. Cl.
CPC ..... *G03G 15/0121* (2013.01); *G03G 9/08711* (2013.01); *G03G 9/08731* (2013.01);
(Continued)

(58) Field of Classification Search
CPC ..... G03G 15/0121; G03G 21/18; G03G 9/08711; G03G 9/08731; G03G 9/08755;
(Continued)

(56) References Cited

U.S. PATENT DOCUMENTS 5,223,368 A * 6/1993 Ciccarelli ..... G03G 9/09783 430/108.3
2001/0010887 A1* 8/2001 Sawano ..... C07F 7/006 430/108.3
(Continued)

FOREIGN PATENT DOCUMENTS

EP 1 686 426 A2 8/2006
JP 08-220821 8/1996
(Continued)

OTHER PUBLICATIONS

International Search Report dated Mar. 31, 2015 for counterpart International Patent Application No. PCT/JP2015/050567 filed Jan. 6, 2015.
(Continued)

*Primary Examiner* — Thorl Chea
(74) *Attorney, Agent, or Firm* — Oblon, McClelland, Maier & Neustadt, L.L.P.

(57) ABSTRACT

A toner for electrophotography, which contains a binder resin, and a release agent, wherein a maximum value of loss tangent of the toner at 95° C. to 115° C. is 8 or greater, as
(Continued)

a viscoelasticity of the toner is measured, where the loss tangent is represented by the following formula: Loss tangent (tan δ)=loss elastic modulus (G")/storage elastic modulus (G').

7 Claims, 4 Drawing Sheets

(51) Int. Cl.
*G03G 15/01* (2006.01)
*G03G 9/097* (2006.01)
*G03G 21/18* (2006.01)

(52) U.S. Cl.
CPC ..... *G03G 9/08755* (2013.01); *G03G 9/08782* (2013.01); *G03G 9/08795* (2013.01); *G03G 9/08797* (2013.01); *G03G 9/09708* (2013.01); *G03G 21/18* (2013.01); *G03G 15/01* (2013.01)

(58) Field of Classification Search
CPC ..... G03G 9/08782; G03G 9/08795; G03G 9/08797; G03G 9/09708; G03G 15/01
See application file for complete search history.

(56) References Cited

U.S. PATENT DOCUMENTS

| | | | | |
|---|---|---|---|---|
| 2003/0129517 | A1* | 7/2003 | Hotta | G03G 9/0821 430/108.22 |
| 2006/0063082 | A1* | 3/2006 | Mikuriya | G03G 9/0804 430/108.3 |
| 2006/0177756 | A1 | 8/2006 | Sugimoto et al. | |
| 2008/0227003 | A1 | 9/2008 | Honda et al. | |
| 2009/0233199 | A1 | 9/2009 | Nozaki et al. | |
| 2010/0183968 | A1* | 7/2010 | Sugawara | G03G 9/08782 430/108.1 |
| 2011/0081608 | A1* | 4/2011 | Yaguchi | G03G 9/0806 430/105 |
| 2012/0237868 | A1 | 9/2012 | Yamada et al. | |
| 2012/0251168 | A1 | 10/2012 | Nagayama et al. | |
| 2012/0251169 | A1 | 10/2012 | Aoki et al. | |
| 2013/0196260 | A1* | 8/2013 | Yoshida | G03G 9/08755 430/105 |
| 2013/0260307 | A1 | 10/2013 | Nagayama et al. | |
| 2014/0162180 | A1 | 6/2014 | Jin et al. | |
| 2014/0255840 | A1 | 9/2014 | Sekiguchi et al. | |
| 2014/0348550 | A1 | 11/2014 | Nagayama et al. | |

FOREIGN PATENT DOCUMENTS

| | | | | |
|---|---|---|---|---|
| JP | 2000-003067 | | | 1/2000 |
| JP | 2002-156796 | A | | 5/2002 |
| JP | 2002-156796 | A5 | | 5/2002 |
| JP | 2003-005432 | | | 1/2003 |
| JP | 2005-300997 | A | | 10/2005 |
| JP | 2005-300997 | A5 | | 10/2005 |
| JP | 2006-208609 | | | 8/2006 |
| JP | 2008-76452 | A | | 4/2008 |
| JP | 2009-217083 | | | 9/2009 |
| JP | 2010-60765 | A | | 3/2010 |
| JP | 2011-100106 | | | 5/2011 |
| JP | 2011-118128 | A | | 6/2011 |
| JP | 2012-163774 | | | 8/2012 |
| JP | 2012-189771 | | | 10/2012 |
| JP | 2012-189929 | | | 10/2012 |
| JP | 2012-194453 | | | 10/2012 |
| JP | 2012-208142 | | | 10/2012 |
| JP | 2012-208217 | | | 10/2012 |
| JP | 2012-215739 | | | 11/2012 |
| JP | 2012-215810 | | | 11/2012 |
| JP | 2013-15673 | A | | 1/2013 |
| JP | 2013-160776 | | * | 8/2013 |
| RU | 2 386 158 | C1 | | 4/2010 |
| WO | WO2012/161138 | | | 11/2012 |

OTHER PUBLICATIONS

Extended European Search Report dated Oct. 17, 2016 in Patent Application No. 15737477.8.
Office Action dated Oct. 30, 2017 in Korean Patent Application No. 10-2016-7022490 (with English language translation).
Combined Office Action and Search Report dated Oct. 2, 2017 in Russian Patent Application No. 2016133567/28(052083) (with English language translation).

* cited by examiner

TONER FOR ELECTROPHOTOGRAPHY, IMAGE FORMING METHOD, AND PROCESS CARTRIDGE

TECHNICAL FIELD

The present invention relates to a toner for use in electrophotography, an image forming method, and a process cartridge.

BACKGROUND ART

An electrophotographic method used for an image forming apparatus, such as a laser printer, and a dry latent electric printer, is typically composed of the following steps (1) to (5).

(1) An image bearing surface, such as a photoconductive layer, is uniformly charged.

(2) The image bearing surface is exposed to light, and the electric charge of the exposed area is dispersed to form an electrically latent image.

(3) A fine powder having electric charge, so-called a toner, is deposited on the latent image to visualize the image.

(4) After transferring the obtained visible image onto a recording medium, such as transfer paper, the image is permanently fixed by heating and pressing.

(5) The fine powder remained on the image bearing surface without being transferred is cleaned.

As for a heating unit or method, a heat roller, an oven, or flash light irradiation is used, and heating temperature is controlled by means of a thermostat or another sensor.

As for a recent image forming apparatus, there is a high demand for energy saving during fixing of a toner, or high-speed processability. Therefore, a toner itself is required to have properties that the toner is melted at low temperature.

In the case where low temperature fixing is achieved by merely reducing a melting point of a toner, however, there is a concern about storage stability of the toner.

Moreover, a demand for high image quality is also high. As for high quality image formation, such as a photographic image, there is a need for providing a vivid high gloss image.

In the aforementioned heat-fixing method, moreover, a surface temperature of a heat roller is controlled depending on the properties of the toner for use, for example when the heat-fixing is performed with the heat roller. In this case, the surface temperature of the heat roller is varied depending on the operation and standing of the heat roller, a feeding state of recording paper, environmental conditions, and overshoot of the heat roller. Therefore, there is a problem that high gloss needs to be achieved regardless of a variation in the fixing temperature.

As for a method for forming a glossy image on an identical recording medium in electrophotography, proposed are a method where gloss is controlled with a number average molecular weight of a resin used in a toner (PTL 1), and a method where releasing properties are enhanced during fixing by encapsulating a release agent in each toner particle (PTL 2).

Moreover, PTL 3 discloses a technology that a gloss control layer is formed on a toner image, where the gloss control layer uses colorless transparent gloss control particles containing a binder resin, and a material that softens the binder resin during heat-fixing.

Furthermore, proposed are methods where gloss is controlled by adjusting viscoelasticity of a toner (PTL 4 to PTL 10). Among these methods, PTL 5 teaches that gloss is imparted by softening the colorless transparent gloss control particles during fixing to level an image surface.

As described above, there are various methods for controlling gloss on the recording medium. For example, PTL 1 teaches that smoothness is increased, and gloss of a clear toner part is partially increased by using a polyester resin having a number average molecular weight of about 3,500 in a clear toner and a polyester resin having a number average molecular weight of about 10,000 in a color toner, and adjusting the melting point of the clear toner lower than the melting point of the color toner.

As the clear toner is formed at an outermost layer of an image, and is directly in contact with a fixing device, the clear toner is required to have higher hot offset resistance than the color toner. Moreover, the clear toner is formed on an image formed of the color toner, and therefore the toner layer becomes thick. Unless the color toner has high cold offset resistance, stability is insufficient with a combination of the clear toner having a low melting point and the color toner having a high melting point.

In the case where a toner is provided with high hot offset resistance, hot offset is typically prevented by introducing a crosslinking monomer to a resin for use to widen a molecular weight of the resin.

If a crosslinking monomer is introduced, however, flowability is not exhibited due to an influence of an elastic component, a smoothness of a toner surface is impaired, and gloss is low, through the hot offset can be prevented.

Moreover, PTL 2 discloses that a toner uses a styrene-acryl resin in order to disperse a release agent in a polyester resin, and hence provided is a toner containing the release agent having a size that can easily exhibit releasing properties, and having fewer side effects due to the release agent. Moreover, it is disclosed that reduction in gloss is prevented by using a certain type of acryl in the resin.

However, spot high glossiness close to photographic gloss, which has been realized by spot varnish, has not yet been realized.

In the method disclosed in PTL 3, a material, which softens the binder resin of the gloss control particles, has a low melting point. Therefore, there is a case where a resulting toner has insufficient storage stability.

Moreover, PTL 4 to PTL 10 disclose that the high gloss is realized when a loss tangent, represented by loss elastic modulus (G")/storage elastic modulus (G')=loss tangent (tan δ), has the maximum peak at 80° C. to 160° C., as the viscoelasticity of the toner is measured, and the maximum peak value of the loss tangent is 3 or greater. However, PTL 4 to PTL 10 do not disclose whether or not there is a width in the fixing temperature exhibiting high gloss.

CITATION LIST

Patent Literature

PTL 1: Japanese Patent Application Laid-Open (JP-A) No. 08-220821
PTL 2: JP-A No. 2003-5432
PTL 3: JP-A No. 2009-217083
PTL 4: JP-A No. 2011-100106
PTL 5: JP-A No. 2012-189771
PTL 6: JP-A No. 2012-189929
PTL 7: JP-A No. 2012-194453
PTL 8: JP-A No. 2012-208142
PTL 9: JP-A No. 2012-215739
PTL 10: JP-A No. 2012-215810

SUMMARY OF INVENTION

Technical Problem

The present invention aims to provide a toner for electrophotography, which achieves high gloss that is close to gloss of a photograph in a wide range of fixing temperature, and can achieves all of extremely excellent low temperature fixing ability, high hot offset resistance, and excellent storage stability.

Solution to Problem

The present inventors have diligently conducted researched to solve the aforementioned problems. The present invention is accomplished based on the researches conducted by the present inventors.

The aforementioned problems can be solved with a toner for electrophotography specified in (1) of the present invention.

(1) A toner for electrophotography, containing:

a binder resin; and a release agent, wherein a maximum value of loss tangent of the toner at 95° C. to 115° C. is 8 or greater, as a viscoelasticity of the toner is measured, where the loss tangent is represented by the following formula:

Loss tangent (tan δ)=loss elastic modulus (G")/storage elastic modulus (G').

Advantageous Effects of Invention

The present invention can provide a toner for electrophotography, which achieves high gloss that is close to gloss of a photograph in a wide range of fixing temperature, and can achieves all of extremely excellent low temperature fixing ability, high hot offset resistance, and excellent storage stability.

DESCRIPTION OF EMBODIMENTS

Figure 1:
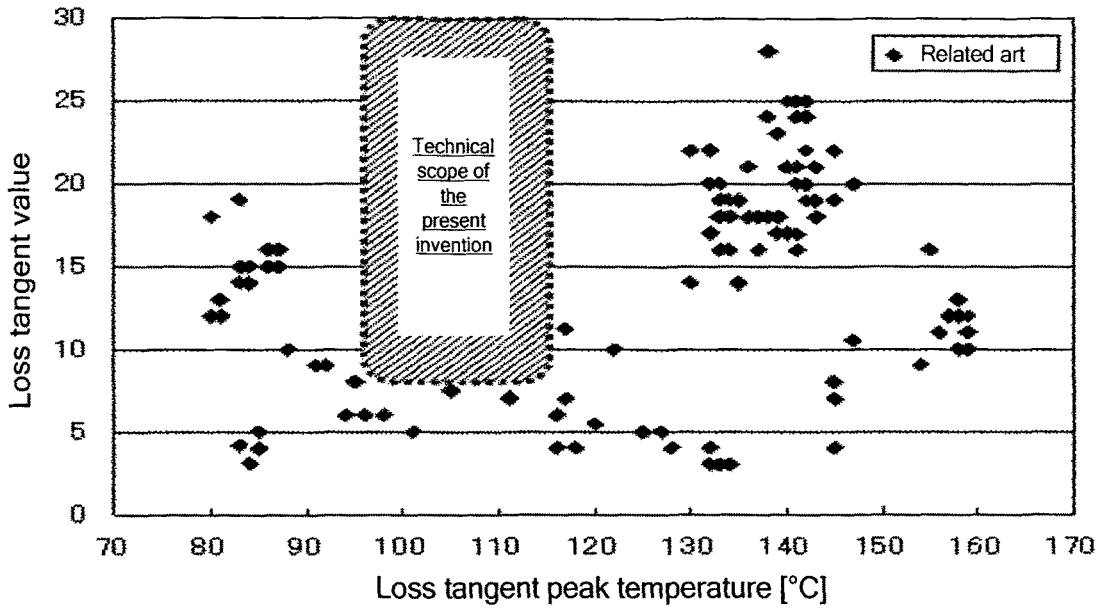
FIG. 1 is a diagram illustrating a relationship between the loss tangent peak temperature (° C.) and the loss tangent value.

As described above, the present invention involves the toner for electrophotography as specified in (1). The present invention moreover includes the toner for electrophotography specified in (2) to (6), which can be understood from the detailed descriptions below. Moreover, the present invention involves the image formation method, the process cartridge, and the printed matter specified in (7) to (10).

(2) The toner for electrophotography according to (1), where the release agent is monoester wax.

(3) The toner according to (1) or (2), wherein the binder resin is a polyester resin, and an acid value of the toner is 6 mgKOH/g to 12 mgKOH/g, and wherein the toner further contains a trivalent or higher metal salt.

(4) The toner according to any one of (1) to (3), wherein the toner further contains a wax-dispersing agent, which is a copolymer resin containing at least styrene, butyl acrylate, and acrylonitrile as monomers.

(5) The toner according to any one of (1) to (4), wherein the toner is a clear toner that is free from a colorant.

(6) The toner according to any one of (1) to (4), wherein the toner is a color toner that contains a colorant.

(7) An image forming method, containing:

superimposing a color toner and the toner according to (5) to form an image; and simultaneously fixing the image, in which the color toner and the toner are superimposed, on a recording medium.

(8) The image forming method according to (7), wherein a difference in glossiness between the color toner and the toner is 30 or greater.

(9) A process cartridge, containing:

an image bearer; and a developing device configured to develop an electrostatic latent image formed on the image bearer with a developer containing a toner and a carrier to form a visible image, wherein the image bearer and the developing device are integratedly supported, and the process cartridge is detachably mounted in a main body of an image forming apparatus, and wherein the toner is the toner according to any one of (1) to (6).

(10) Printed matter, containing:

an image formed by the image forming method according to (7) or (8).

The preferred embodiment for carrying out the present invention is explained with reference to drawings hereinafter.

Note that, the following descriptions are examples of the preferred embodiment of the present invention, and the following descriptions shall not construed as to limit the scope of the present invention, as a person skilled in the art can easily carry another embodiment with a modification or change applied to the following embodiment within the scope of the present invention.

As described above, the toner of the present invention is a toner for electrophotography, which contains at least a binder resin, and a release agent, where a maximum value of a loss tangent of the toner at 95° C. to 115° C. is 8 or greater, as a viscoelasticity of the toner is measured, and the loss tangent is represented by the following formula:

$$\text{Loss tangent}(\tan\delta)=\text{loss elastic modulus}(G'')/\text{storage elastic modulus}(G')$$

The reasons for this are explained hereinafter.

In order to perform fixing at low temperature as well as securing high glossiness, it is necessary to give the toner the properties where storage elasticity thereof becomes significantly low at relatively low temperature. If the storage elastic modulus (G') of the toner during fixing can be reduced, the toner easily penetrate into minor irregularities of recording paper having low surface smoothness, or that made with a color toner, and a plasticity component content becomes relatively high in viscoelasticity. Therefore, it is difficult to recover shapes of the toner particles after pressure fixing. As a result, the toner has excellent ductility, a surface of the toner layer has high smoothness, and thus high glossiness can be attained.

On the other hand, it is important in view of hot offset resistant that, after the storage elastic modulus (G') reaches a certain level, an inclination of reduction of the storage elastic modulus (G') becomes mild, and such the level is maintained.

Moreover, the loss elastic modulus (G") does not significantly drop at least at the range of 95° C. to 115° C., unlike the storage elastic modulus (G'). Namely, the loss elastic modulus (G") has relatively small temperature-dependency within the aforementioned temperature range.

Figure 2:
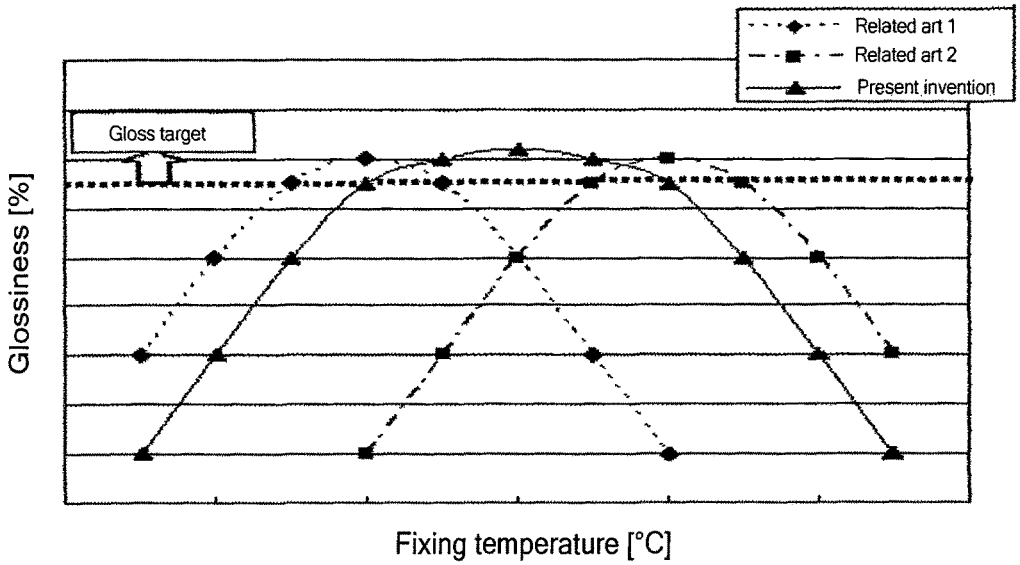
FIG. 2 is an image diagram of the fixing temperature and the glossiness.

The relationship between the loss tangent peak temperature (° C.) and the loss tangent value of PTL 4 to PTL10, which are related art, is depicted in FIG. 1, and FIG. 2 illustrate an image diagram of the fixing temperature and glossiness. In the aforementioned related art, the toner whose loss tangent peak temperature is 110° C. or lower, and the toner, which has the maximum loss tangent value at 110° C. or higher are proposed. The toner whose loss tangent peak temperature is 110° C. or lower has the low maximum loss tangent value at the aforementioned temperature, and causes reduction of glossiness at high temperature. Therefore, the temperature width of high glossiness cannot be maintained (Related Art 1 in FIG. 2). Moreover, the toner whose loss tangent peak temperature is 110° C. or higher has a low onset of gloss at low temperature, and thus the temperature width of high gloss cannot be maintained (Related Art 2 in FIG. 2).

Figure 3:
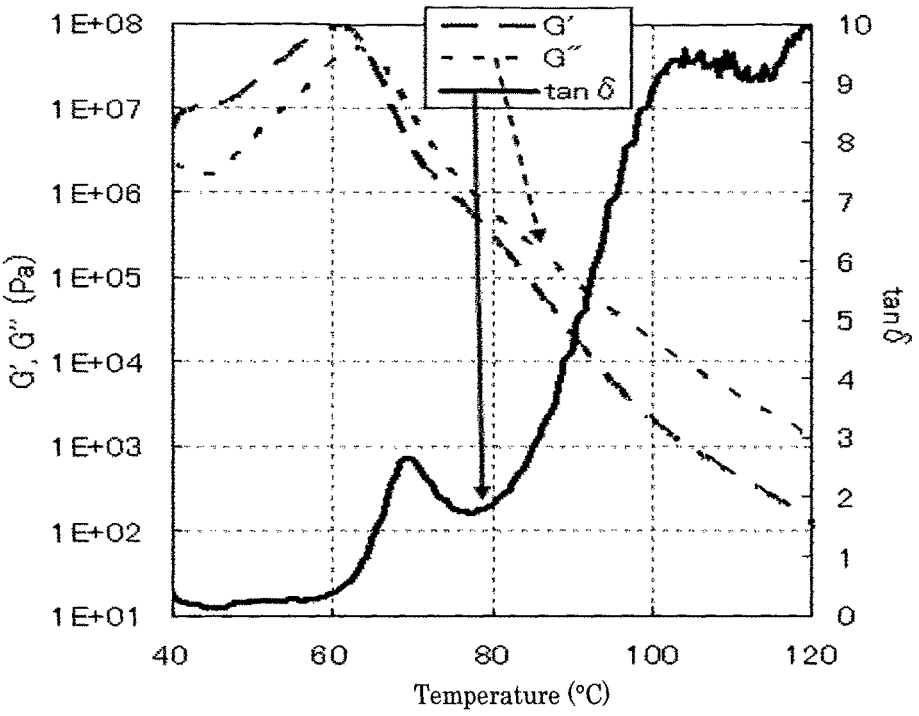
FIG. 3 is a diagram illustrating an example of a viscoelasticity of the toner where the maximum value of the loss tangent at 95° C. to 115° C. is 8 or greater.

As described above, the peak of the loss tangent as illustrated in FIG. 3 is not exhibited, unless the storage elastic modulus (G') starts significantly reducing from certain temperature, and the inclination of the reduction becomes mild in a certain temperature range. Note that, "E" of the vertical axis of the graph of FIG. 3 represents an exponentiation of 10. Specifically, "E+01" represents 10, and "E+02" represents 100.

It is preferred that the toner having the aforementioned relationship of G", G' and tan δ has the maximum loss tangent value of 8 or greater at 95° C. to 115° C.

When the temperature at which the maximum loss tangent value is 8 or greater is lower than 95° C., the storage elastic modulus (G') reduces in the storing environment, and storage stability of the toner becomes poor, which may cause aggregation of the toner particles in the storing environment. Moreover, the viscoelasticity at high temperature is excessively low, and thus hot offset resistance may be impaired.

When the temperature at which the maximum loss tangent value is 8 or greater is higher than 115° C., the purpose of fixing at low temperature may be undermined.

The present inventors have diligently conducted studies on these phenomena. As a result, it has been found out that high gloss close to photographic gloss is exhibited over a wide fixing temperature range, and all of extremely excellent low temperature fixing ability, hot offset resistance against high temperature, and excellent storage stability can be realized, when a maximum value of a loss tangent (tan δ), which is a ratio of a loss elastic modulus (G") and storage elastic modulus (G') of a toner, is 8 or greater.

In addition, the "maximum loss tangent value at 95° C. to 115° C. being 8 or greater" that has not yet been realized in the conventional art can be relatively easily achieved, when a toner contains a binder resin containing a polyester resin, a release agent containing monoester wax, and a trivalent or higher metal salt. The details thereof are more specifically explained later.

The loss tangent (tan δ) of the toner is determined by the viscoelasticity measurement. In the present invention, the toner is formed into a shape using a die having a weight of 0.8 g, and a diameter of 20 mm at the pressure of 30 MPa. The resulting sample is subjected to the measurements of loss elastic modulus (G"), storage elastic modulus (G'), and loss tangent (tan δ) using a parallel corn having a diameter of 20 mm, by ADVANCED RHEOMETRIC EXPANSION SYSTEM manufactured by TA Instruments Japan Inc. at the frequency of 1.0 Hz, heating speed of 2.0° C./min, and distortion of 0.1% (automatic distortion control; acceptable minimum stress: 1.0 g/cm, acceptable maximum stress: 500 g/cm, maximum added distortion: 200%, distortion adjustment: 200%). In this case, the value of the loss tangent (tan δ) with which the storage elastic modulus (G') is 10 or less is excluded.

[Release Agent]

As described above, the toner of the present invention preferably contains monoester wax as a release agent. Since the monoester wax has low compatibility to a typical binder resin, the monoester wax easily bleeds out onto surfaces of the toner particles during the fixing to exhibit high releasing properties, and both high gloss and desirable low temperature fixing ability can be secured.

Moreover, the monoester wax is preferably contained in an amount of 4 parts by mass to 8 parts by mass, more preferably 5 parts by mass to 7 parts by mass, relative to 100 parts by mass of the toner. When the amount of the monoester was is less than 4 parts by mass, bleeding of the wax to the surface is insufficient during fixing, and thus releasing properties are poor, which may lead to poor low temperature fixing ability, and hot offset resistance. When the amount thereof is greater than 8 parts by mass, an amount of the release agent precipitating on surfaces of the toner particles increases, and thus storage stability of the toner becomes low, which may lead to poor filming resistance to a photoconductor.

As for the monoester wax, synthetic ester wax is preferably used. Examples of the synthetic ester wax include monoester wax synthesized from a long straight chain saturated fatty acid and long straight chain saturated alcohol. As for the long straight chain saturated fatty acid, a compound represented by a general formula: $C_nH_{2n+1}COOH$, where n is about 5 to about 28, is preferably used. As for the long straight chain saturated alcohol, a compound represented by $C_nH_{2n+1}OH$, where n is about 5 to about 28, is preferably used.

Specific examples of the long straight chain saturated fatty acid include capric acid, undecylic acid, lauric acid, tridecylic acid, myristic acid, pentadecylic acid, palmitic acid, heptadecanoic acid, tetradecanoic acid, stearic acid, nonadecanoic acid, aramonic acid, behenic acid, lignoceric acid, cerotic acid, heptacosanic acid, montanic acid, and melissic acid. Specific examples of the long straight chain saturated alcohol include amyl alcohol, hexyl alcohol, heptyl alcohol, octyl alcohol, capryl alcohol, nonyl alcohol, decyl alcohol, undecyl alcohol, lauryl alcohol, tridecyl alcohol, myristyl alcohol, pentadecyl alcohol, cetyl alcohol, heptadecyl alcohol, stearyl alcohol, nonadecyl alcohol, eicosyl alcohol, ceryl alcohol, and heptadecanol, and these may have a substituent, such as a lower alkyl group, an amino group, and a halogen group.

[Acid Value of Toner]

Moreover, an acid value of the toner of the present invention is preferably 6 mgKOH/g to 12 mgKOH/g. By appropriately forming a crosslinking structure between the acid group in the polyester resin and the below-described trivalent or higher metal salt during the fixing, more excellent hot offset resistance can be attained with maintaining low temperature fixing ability.

When the acid value is higher than 12 mgKOH/g, the resulting toner has excellent hot offset resistance, but poor low temperature fixing ability, as a number of the crosslinking structures with the metal salt increases. When the acid value is lower than 6 mgKOH/g, it is difficult to secure hot offset resistance, as a number of the crosslinking structures decreases.

The acid value of the toner can be measured under the following conditions by the measuring method specified in JIS K0070-1992.

Preparation of sample: To 120 mL of toluene, 0.5 g of the toner (0.3 g of an ethyl acetate soluble component) is added, and the resultant is stirred at room temperature (23° C.) for about 10 hours to dissolve the toner. To this, 30 mL of ethanol is further added, to thereby prepare a sample solution.

The measurement can be calculated by the below-described measuring device, but specifically, the calculation is performed as follows. The sample is titrated with a N/10 potassium hydroxide alcohol solution, which has been standardized in advance. The acid value is determined from the consumed amount of the potassium hydroxide alcohol solution using the following equation.

Acid Value=KOH(number of mL)×N×56.1/mass of sample(provided that N is a factor of N/10KOH)

Specifically, the acid value of the toner is determined in the following manner.

Measuring device: automatic potentiometric titrator DL-53 Titrator (manufactured by Mettler-Toledo International Inc.)
Electrode for use: DG113-SC (manufactured by Mettler-Toledo International Inc.)
Analysis software: LabX Light Version 1.00.000
Calibration of device: A mixed solvent of toluene (120 mL) and ethanol (30 mL) is used.
Measuring temperature: 23° C.

The measuring conditions are as follows.

Stirring Conditions
- Stirring speed [%]: 25
- Stirring time [s]: 15

Equivalent Titration Conditions
- Titrant $CH_3ONa$
- Concentration [mol/L]: 0.1
- Electrode: DG115
- Measurement unit: mV Dripping of Titrant before Measurement
- Dripping amount [mL]: 1.0
- Standing time [s]: 0
- Titrant dripping mode: Dynamic
- dE(set) [mV]: 8.0
- dV(min) [mL]: 0.03
- dV(max) [mL]: 0.5

Measuring mode: equivalent titration
- dE[mV]: 0.5
- dt[s]: 1.0
- t(min) [s]: 2.0
- t(max) [s]: 20.0

Identification Conditions
- Threshold: 100.0
- Only maximum rate of change: No
- Range: No
- Frequency: None Measurement Termination Conditions
- Maximum drip [mL]: 10.0
- Potential: No
- Gradient: No
- After equivalence point: Yes
- N number: 1
- Combination of termination conditions: No Evaluation Conditions
- Procedure: Standard
- Potential 1: No
- Potential 2: No
- Termination for re-evaluation: No

[Binder Resin]

The binder resin contained in the toner of the present invention preferably contains a polyester resin as a main component (occupying 50% by mass or greater in the entire binder resin). Of course, other resins, such as polystyrene, an acrylic resin, a styrene-acryl copolymer resin, can be also used. Not only these resins have been conventionally often used as a material for a pulverized toner, but also these resins are used as a material for producing a color master batch serving as a coloring material, in case of a polymerization toner or a semi-polymerization toner. Moreover, polystyrene, or polystyrene copolymer is excellent in dispersing wax.

The weight average molecular weight (Mw) of the polyester resin is preferably 7,000 to 10,000, more preferably 7,500 to 9,500, and even more preferably 8,000 to 9,000. The ratio (Mw/Mn) of the weight average molecular weight (Mw) of the polyester resin to the number average molecular weight (Mn) thereof is preferably 5 or less, more preferably 4 or less. Moreover, the acid value of the polyester resin is preferably 12 mgKOH/g or less, more preferably 6 mgKOH/g to 12 mgKOH/g. Use of the polyester resin contributes to attain both of low temperature fixing ability and hot offset resistance of the resulting toner.

As for the polyester resin for use in the present invention, any of polyester resins obtained by a conventional polycondensation reaction between alcohol and acid can be used. Examples of the alcohol include: diol, such as polyethylene glycol, diethylene glycol, triethylene glycol, 1,2-propylene glycol, 1,3-propylene glycol, 1,4-propylene glycol, neopentyl glycol, and 1,4-butenediol; etherified bisphenol, such as 1,4-bis(hydroxymethyl)cyclohexane, bisphenol A, hydrogenated bisphenol A, bisphenol A polyoxyethylene adduct, and bisphenol A polyoxypropylene adduct; a bivalent alcohol monomer, in which any of the aforementioned alcohols is substituted with a C3-C22 saturated or unsaturated hydrocarbon group; other bivalent alcohol monomers; a trivalent or higher polyhydric alcohol monomer, such as sorbitol, 1,2,3,6-hexanetetrol, 1,4-sorbitan, pentaerythritol, dipentaerythritol, tripentaerythritol, saccharose, 1,2,4-butanetriol, 1,2,5-pentanetriol, glycerol, 2-methylpropanetriol, 2-methyl-1,2,4-butanetriol, trimethylol ethane, trimethylol propane, and 1,3,5-trihydroxymethylbenzene.

Moreover, examples of the carboxylic acid used for obtaining the polyester resin include: monocarboxylic acid, such as palmitic acid, stearic acid, and oleic acid; bivalent carboxylic acid, such as maleic acid, fumaric acid, measaconic acid, citraconic acid, terephthalic acid, cyclohexane dicarboxylic acid, succinic acid, adipic acid, sebacic acid, and malonic acid, and a bivalent organic acid monomer, in which any of these is substituted with C3-C22 saturated or unsaturated hydrocarbon group; a dimmer of anhydride or lower alkyl ester of any of these acid with linoleic acid; and a trivalent or higher multicalent carboxylic acid monomer, such as 1,2,4-benzene tricarboxylic acid, 1,2,5-benzene tricarboxylic acid, 2,5,7-nephthalene tricarboxylic acid, 1,2,4-naphthalene tricarboxylic acid, 1,2,4-butane tricarboxylic acid, 1,2,5-hexane tricarboxylic acid, 1,3-dicarboxyl-2-methyl-2-methylenecarboxydipropane, tetra(methylenecarboxyl)methane, 1,2,7,8-octane tetracarboxylic acid, Empol trimer acid, and anhydride of any of these acids.

In the present invention, moreover, "the maximum loss tangent value at 95° C. to 115° C. being 8 or greater" can be achieved, for example, by selecting the releasing agent, and adding the trivalent or higher metal salt, as described above. As for the binder resin itself, moreover, it can be relatively easily and surely achieved by adjusting a molecular weight of the polyester resin. In order to adjust conformation or configuration of a polymer structure of the binder resin, it is relatively easily and surely achieved by combining any of modification of part of a segment, such as bulking, and adjustment of an arrangement of segment units, not only using a linear structure segment, such as a paraffin structure segment, as a principal chain segment, within a range where heat resistant storage stability and sharp melt at the time of heating are both achieved. To this end, for example, introduction of a non-linear segment, such as a branched structure segment, and a star structure segment, and introduction of an aromatic segment, can be combined.

[Trivalent or Higher Metal Salt]

As explained above, the toner of the present invention preferably further contains a trivalent or higher metal salt. Since the metal salt is contained in the toner, the metal salt carries out a cross-linking reaction with an acid group of the binder resin to form a weak three-dimensional crosslink. As a result, hot offset resistance can be attained with securing low temperature fixing ability.

The metal salt is, for example, preferably at least one selected from the group consisting of a metal salt of a salicylic acid derivative, and a metal salt of acetyl acetonate. The metal is not particularly limited, as long as it is a trivalent or higher multivalent metal. Examples of the metal include iron, zirconium, aluminium, titanium, and nickel.

Preferable examples of the trivalent or higher metal salt include a trivalent or higher salicylic acid metal compound.

An amount of the metal salt is, for example, preferably 0.5 parts by mass to 2 parts by mass, more preferably 0.5 parts by mass to 1 part by mass, relative to 100 parts by mass of the toner. When the amount thereof is less than 0.5 parts by mass, hot offset resistance of the resulting toner may be poor. When the amount thereof is greater than 2 parts by mass, moreover, glossiness and low temperature fixing ability of the resulting toner may be poor, through the hot offset resistance of the toner is excellent.

[Wax-Dispersing Agent]

The toner of the present invention preferably further contains a wax-dispersing agent. It is more preferred that the wax-dispersing agent be a copolymer composition containing at least styrene, butyl acrylate, and acrylonitrile as monomers, or a polyethylene adduct of the copolymer composition.

Compared to the polyester resin, which is a binder resin of the toner of the present invention, a styrene resin has better compatibility to typical wax. Therefore, the wax tends to be finely dispersed. Moreover, the styrene resin has a weak internal cohesive power, hence the styrene resin is excellent in puverlizability compared to the polyester resin. Even when the wax dispersion state therein is the same as in the polyester resin, the probability that the interface between the wax and the resin becomes a crushed surface, as in case of the polyester resin, is low, the wax present on surfaces of the toner particles is reduced, and therefore storage stability of the toner is enhanced.

Since the polyester resin, which is the binder resin of the toner of the present invention, and the styrene-based resin are incompatible, gloss may be reduced. In the present invention, even when the incompatible resin is contained in the toner, reduction in gloss can be suppressed by selecting butyl acrylate as an acryl type, SP value of which is close to a polyester-based resin among typical styrene-based resins. In the case where the aryl type is butyl acrylate, the thermal properties thereof are close to those of the polyester resin, and low fixing ability and internal cohesive power the polyester resin has are not largely impaired by such the resin.

The wax-dispersing agent is preferably contained in an amount of 7 parts by mass or less relative to 100 parts by mass of the toner. As the wax-dispersing agent is contained, a more excellent effect of dispersing wax is attained, a keeping quality of the toner is stably improved without being affected by a production method thereof. Moreover, filming of the toner to a photoconductor can be prevented, as a diameter of the dispersed wax reduces due to an effect of dispersing the wax. When the amount of the wax-dispersing agent is greater than 7 parts by mass, a component that is incompatible to the polyester resin increases and hence gloss may be reduced. Since dispersibility of the wax becomes excessively high, moreover, bleeding of the wax to the surface is insufficient during fixing, and therefore low temperature fixing ability and hot offset resistance may be insufficient, through filming resistance is improved.

[Colorant]

Examples of the colorant include carbon black, Nigrosine dye, black iron oxide, naphthol yellow S, Hansa yellow (10G, 5G and G), cadmium yellow, yellow iron oxide, yellow ocher, yellow lead, titanium yellow, polyazo yellow, oil yellow, Hansa yellow (GR, A, RN and R), pigment yellow L, benzidine yellow (G and GR), permanent yellow (NCG), vulcan fast yellow (5G, R), tartrazine lake, quinoline yellow lake, anthrasan yellow BGL, isoindolinon yellow, colcothar, red lead, lead vermilion, cadmium red, cadmium mercury red, antimony vermilion, permanent red 4R, para-red, fiser red, parachloroorthonitro aniline red, lithol fast scarlet G, brilliant fast scarlet, brilliant carmine BS, permanent red (F2R, F4R, FRL, FRLL, F4RH), fast scarlet VD, vulcan fast rubin B, brilliant scarlet G, lithol rubin GX, permanent red FSR, brilliant carmine 6B, pigment scarlet 3B, Bordeaux 5B, toluidine Maroon, permanent Bordeaux F2K, Helio Bordeaux BL, Bordeaux 10B, BON maroon light, BON maroon medium, eosin lake, rhodamine lake B, rhodamine lake Y, alizarin lake, thioindigo red B, thioindigo maroon, oil red, quinacridone red, pyrazolone red, polyazo red, chrome vermilion, benzidine orange, perinone orange, oil orange, cobalt blue, cerulean blue, alkali blue lake, peacock blue lake, Victoria blue lake, metal-free phthalocyanine blue, phthalocyanine blue, fast sky blue, indanthrene blue (RS, BC), indigo, ultramarine, iron blue, anthraquinone blue, fast violet B, methyl violet lake, cobalt purple, manganese violet, dioxane violet, anthraquinone violet, chrome green, zinc green, chromium oxide, viridian, emerald green, pigment green B, naphthol green B, green gold, acid green lake, malachite green lake, phthalocyanine green, anthraquinone green, titanium oxide, zinc flower, lithopone, and a mixture thereof. An amount of the colorant for use is typically 0.1 parts by mass to 80 parts by mass relative to 100 parts by mass of the binder resin.

[External Additives]

Moreover, the clear toner or color toner can further contain external additives.

As for the external additives, for example, a polishing agent (e.g., silica, Teflon (registered trade mark) resin powder, poly vinylidene fluoride powder, cerium oxide powder, silicon carbide powder, and strontium titanate), a flowability imparting agent (e.g., titanium oxide powder, and aluminium oxide powder), a deflocculating agent, resin powder, or a conduction imparting agent (e.g., zinc oxide powder, antimony oxide powder, and tin oxide powder), and a developing improving agent (e.g., white particles or black particles of reverse polarity) can be used. These may be used alone, or in combination. The external additives for use are selected to impart a resistance against developing stress (e.g., idle running) to the toner.

[Developer]

In the case where a two-component developing system is used, spinel ferrite (e.g., magnetite, and gamma ferric oxide), magnetoplumbite-type ferrite (e.g., spinel ferrite containing one or two or more metals [e.g., Mn, Ni, Zn, Mg, and Cu] other than iron, and barium ferrite), or iron or alloy particles, each of which has an oxide layer at a surface, can be used as magnetic particles used for a magnetic carrier. The shape of the magnetic carrier may be particles, spheres, or needle shapes. Especially in the case where high magnetization is required, ferromagnetic particles, such as iron, are preferably used. It is preferred in view of chemical stability that magnetoplumbite-type ferrite (e.g., spinel ferrite containing one or two or more metals [e.g., Mn, Ni, Zn, Mg, and Cu] other than iron, and barium ferrite) be used. It is also possible to use a resin carrier having desired magnetic force by selecting a type and amount of ferromagnetic particle. As for the magnetic properties of the carrier in this case, the strength of the magnetization at 1,000 oersted is preferably 30 mu/g to 150 emu/g.

As for the resin carrier, a resin carrier can be produced by atomizing the melt-kneaded product of magnetic particles and an insulating binder by a spray dryer, or allowing a monomer or prepolymer to react in an aqueous medium in the presence of magnetic particles, followed by curing, to produce a resin carrier, in which the magnetic particles are dispersed in a condensed-type binder.

The charging ability of the magnetic carrier can be controlled by adhering positively or negatively chargable particles r conductive particles on surfaces thereof, or coating the surfaces thereof with a resin.

As for a surface coating material, a silicone resin, an acryl resin, an epoxy resin, or a fluororesin is used. Moreover, the coating material may contain positively or negatively chargable particles, or conductive particles. Among them, a silicone resin, and an acryl resin are preferable.

As for a blending ratio of the toner of the present invention and the magnetic carrier, the toner concentration is preferably 2% by mass to 10% by mass.

Moreover, the weight average particle diameter of the toner is preferably 2 μm to 25 μm.

The granularity of the toner is measured by various method. For example, 50,000 toner particles are measured by means of Coulter Counter Multisizer III using a measuring sample prepared by adding the measuring toner to an electrolyte, to which a surfactant has been added, and dispersing the electrolyte for 1 minute by means of an ultrasonic disperser.

In order to produce the clear toner or color toner of the present invention, for example, a combination of a resin for fixing, a lubricant, an optional colorant, and a further optional resin for fixing, in which a charge controlling agent, a lubricant, and additive are homogeneously dispersed, is sufficiently mixed by means of a mixer, such as HENSCHEL MIXER, and Super Mixer, the mixture is then melt-kneaded by means of a melt-kneader, such as heat rolls, a kneader, and an extruder, to sufficiently mix the materials, and the resultant is cooled and solidified, followed by pulverization and classification. As for the pulverization method, a jet mill system where the toner is included in a high-speed air flow, and the toner is crushed into an impact board to pulverize the toner using this energy, an inter-particle collision system where toner particles are crushed to each other in an air flow, or a mechanical pulverization system where a toner is supplied to a narrow gap between rotors rotating at high speed is used.

Moreover, a dissolution suspension method, where an oil phase, in which toner materials are dissolved or dispersed in an organic solvent phase, is dispersed in an aqueous medium phase to carry out a reaction of the resin, the solvent is removed from the system, and filtration, washing, and drying are performed to produce base particles of the toner, can also be used.

[Image Forming Apparatus, Process Cartridge, and Image Forming Method]

A structure of a developing device of an image forming apparatus for use in the present invention is selected depending on a traveling speed of an image bearer. In the case where the traveling speed of the image bearer is fast, developing is performed by using plurality of developing magnetic rolls to increase a developing region, to thereby extend a developing time.

In the case where pluralities of developing magnetic rolls are used, high developing performance is attained compared to a system using one developing roll. As a result, an amount of the developer can be reduced, as well as corresponding to printing of a large-area image, and improving a printing quality. Moreover, it is also possible to reduce the rotational speed of the developing roll, so that carrier spent of the toner due to scattering of the toner, and reduced load to the developer can be prevented, which leads to a prolonged service-life of the two-component developer.

By using the aforementioned developing system and the toner in combination, a stable image forming apparatus, which provides an excellent image, a stable toner deposition amount both at a character part and at a solid image part, and does not cause transfer failures with a change of printing density can be provided.

As for a method for cleaning the image bearer, a method using a fur brush, a magnetic brush, or a blade has been known. Such the system can be used for the cleaning.

An image forming apparatus A, which is used for evaluation of the clear toner and color toner of the present invention, and a two-component developer containing the clear toner, color toner, and a carrier, is explained hereinafter.

<Image Forming Method 1>

Figure 4:
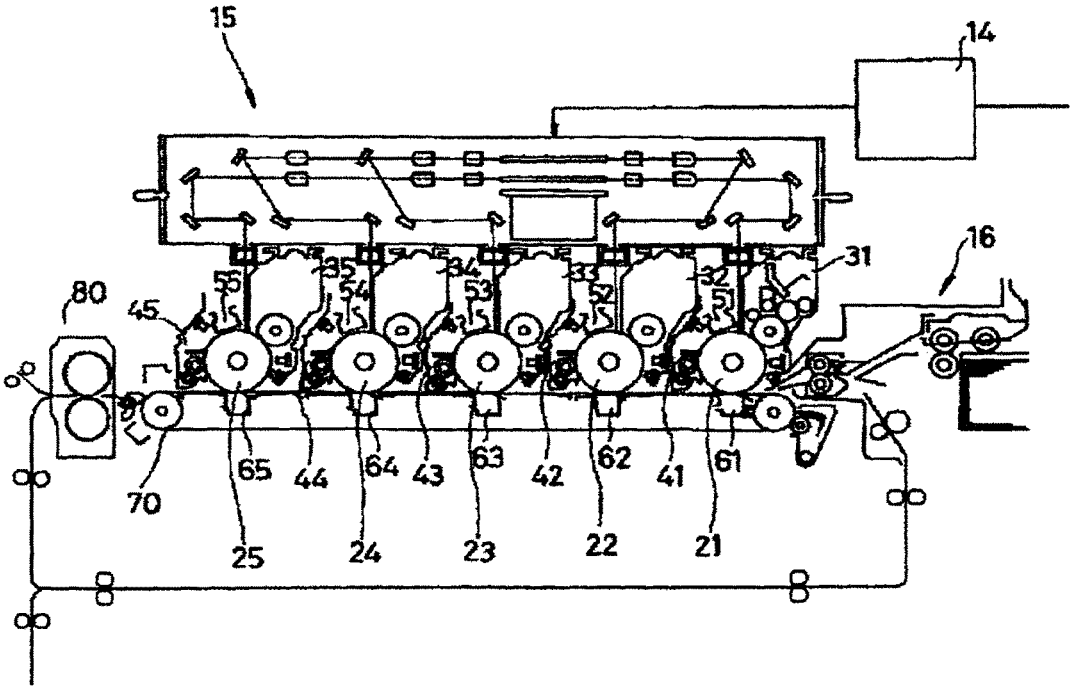
FIG. 4 is a front view illustrating an embodiment of the image forming apparatus A.

FIG. 4 is a diagram illustrating the entire image forming apparatus A. First, the image forming method 1 is explained.

The image data sent to the image processing unit (referred as "IPU" hereinafter) 14 generates image signals of 5 colors, Y (yellow), M (magenta), C (cyan), Bk (black), and clear.

Next, each of the image signals of Y, M, C, Bk, and clear generated in the image processing unit is transmitted to the writing unit 15. The writing unit 15 is configured to modulate and scan 5 laser beams for Y, M, C, Bk, and clear to form electrostatic latent images on photoconductor drums 21, 22, 23, 24, 25, respectively, after charging the photoconductor drums with the charging units 51, 52, 53, 54, 55. For example, the first photoconductor drum 21 is corresponded to Bk, the second photoconductor drum 22 is corresponded to Y, the third photoconductor drum 23 is corresponded to M, the fourth photoconductor drum 24 is corresponded to C, and the fifth photoconductor drum 25 is corresponded to clear.

Next, toner images of 5 colors are respectively formed on the photoconductor drums 21, 22, 23, 24, 25 by the developing units 31, 32, 33, 34, 35 serving as units for depositing developers. Moreover, transfer paper fed by the paper feeding unit 16 is transported on the transfer belt 70. Then, the toner images on the photoconductor drums 21, 22, 23, 24, 25 are sequentially transferred onto the transfer paper by the transfer charges 61, 62, 63, 64, 65.

After the termination of the transfer step, the transfer paper is transported to the fixing unit 80, and the transferred toner images are fixed on the transfer paper by the fixing unit 80.

After the termination of the transfer step, the toner remained on the photoconductor drums 21, 22, 23, 24, 25, is removed by the cleaning units 41, 42, 43, 44, 45, respectively.

<Image Forming Method 2>

Next, the image forming method 2, which partially gives a high gloss to an image, is explained.

Similarly to the image forming method 1, first, the image data sent to the image processing unit (referred as "IPU" hereinafter) 14 generates image signals of 5 colors, Y (yellow), M (magenta), C (cyan), Bk (black), and clear.

Next, first image formation, which partially gives high gloss, is performed by means of the image processing unit. Each of an image signal of part of Y, M, C, Bk, and clear where high gloss is partially applied is transmitted to the writing unit 15. The writing unit 15 is configured to modulate and scan 5 laser beams for Y, M, C, Bk, and clear to form electrostatic latent images on photoconductor drums 21, 22, 23, 24, 25, respectively, after charging the photoconductor drums with the charging units 51, 52, 53, 54, 55. For example, the first photoconductor drum 21 is corresponded to Bk, the second photoconductor drum 22 is corresponded to Y, the third photoconductor drum 23 is corresponded to M, the fourth photoconductor drum 24 is corresponded to C, and the fifth photoconductor drum 25 is corresponded to clear.

Next, toner images of 5 colors are respectively formed on the photoconductor drums 21, 22, 23, 24, 25 by the developing units 31, 32, 33, 34, 35 serving as units for depositing developers. Moreover, transfer paper fed by the paper feeding unit 16 is transported on the transfer belt 70. Then, the toner images on the photoconductor drums 21, 22, 23, 24, 25 are sequentially transferred onto the transfer paper by the transfer charge 61, 62, 63, 64, 65.

After the termination of the transfer step, the transfer paper is transported to the fixing unit 80, and the transferred toner images are fixed on the transfer paper by the fixing unit 80.

After the termination of the transfer step, the toner remained on the photoconductor drums 21, 22, 23, 24, 25, is removed by the cleaning units 41, 42, 43, 44, 45, respectively.

The fixed transfer paper is transported to a fixed transfer paper conveyance unit in order to perform second image formation.

In the second image formation, each of image signals of parts, where the first image is not formed and normal gloss is applied by an image arithmetic process, is transported to the writing unit 15. Here, images of Y, M, C, Bk, other than clear, are written on the photoconductor drums 21, 22, 23, 24, respectively, and then developing, and transfer are performed in the same manner as in the first image formation, followed by performing fixing again by means of the fixing unit.

Note that, image formation for a clear toner can be performed by depositing the clear toner on the area where the density on the print paper is low by an image arithmetic processing, and also it is possible to deposit a clear toner on an entire print paper, or only an area that is judged as an image part by designating a region.

Figure 5:
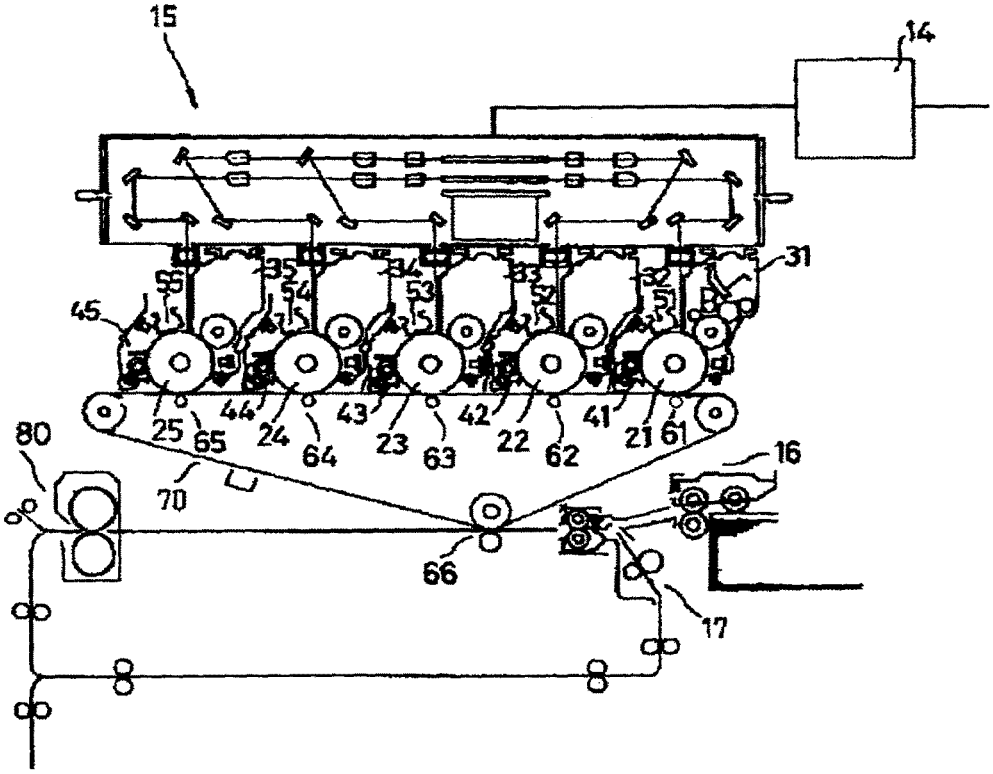
FIG. 5 is a front view illustrating an embodiment of the image forming apparatus B.

In the apparatus of FIG. 5, and the image forming method using the apparatus, similarly to FIG. 4, the toner images formed on the photoconductor drums 21, 22, 23, 24, 25 are temporally transferred on a transfer drum, and then the toner images are transferred on transfer paper by a secondary transfer unit 66, followed by being fixed by a fixing unit 80.

Figure 6:
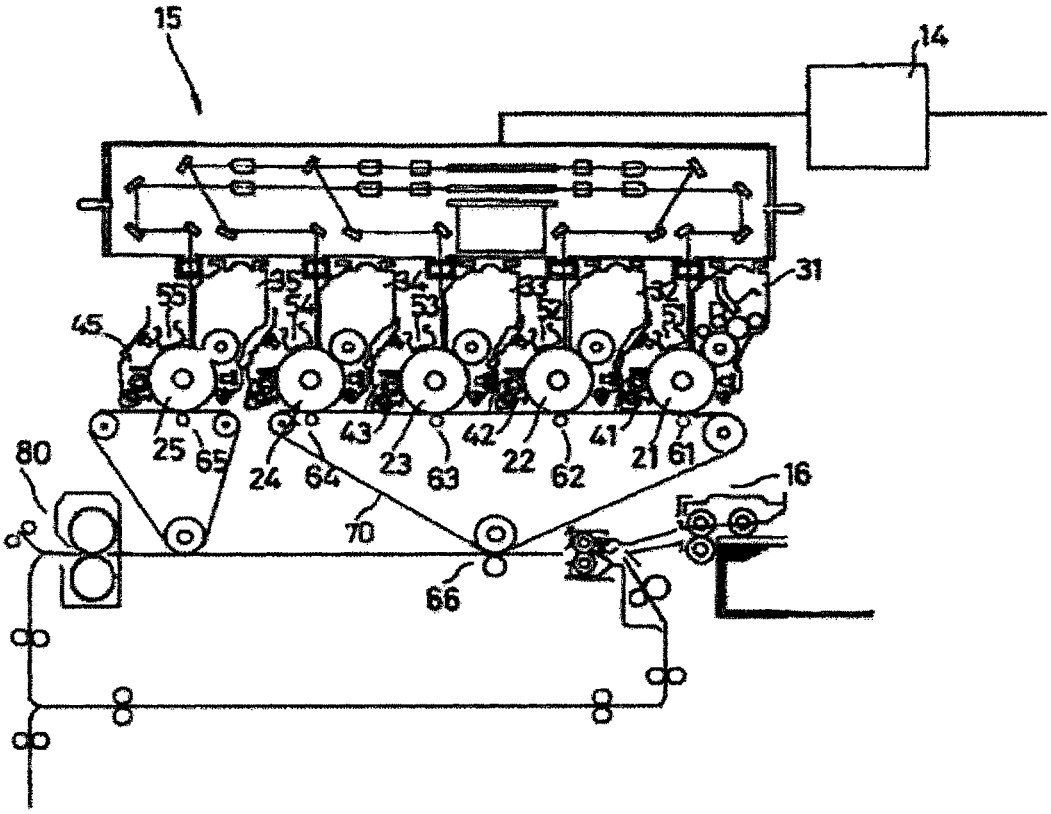
FIG. 6 is a front view illustrating an embodiment of the image forming apparatus C.
Figure 7:
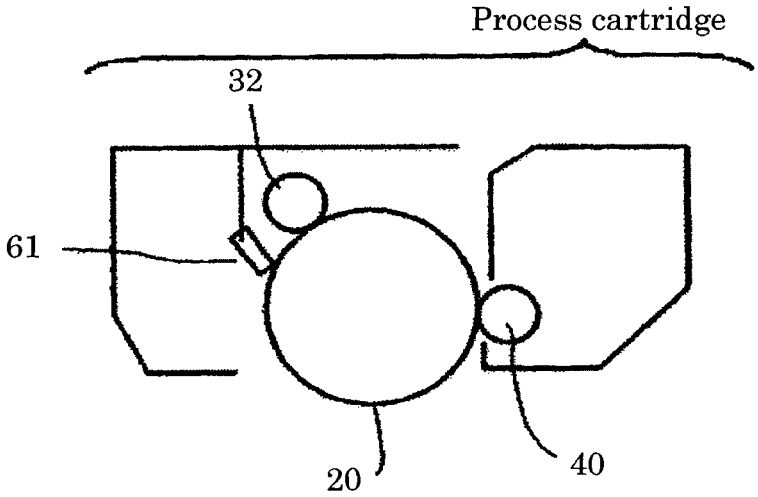
FIG. 7 is a diagram illustrating one example of the process cartridge for use in the present invention.

Both of the image formation method 1 and the image formation method 2 can be used. In the case where the clear toner is applied thick, the cleat toner layer on the transfer drum becomes thick and it is difficult to perform second transfer. Therefore, a separate transfer dram can be used as illustrated in FIG. 6.

EXAMPLES

The present invention is more specifically explained through Examples hereinafter.

Note that, appropriate modifications or changes easily made to Examples of the present invention by the person in the art to carry out another embodiment are included within the present invention. The following descriptions are examples of the preferred embodiment of the present invention, and do no limit the scope of the present invention.

In Examples below, "part(s)" denotes "part(s) by mass," unless otherwise stated.

<Measurement of Glass Transition Temperature (Tg) of Binder Resin>

In the present invention, glass transition temperature (Tg) was measured in the following manner. A sample was weighed in an aluminium pan by 0.01 g to 0.02 g. By means of a differential scanning calorimeter (DSC210, manufactured by Seiko Instruments Inc.), the sample was heated to 200° C., and was then cooled from 200° C. to 20° C. at the cooling rate of 10° C./min. Thereafter, the sample was heated at the heating rate of 10° C./min. The temperature at a cross point between the extended line from the base line equal to or lower than the maximum endothermic peak temperature, and the tangent line indicating the maximum inclination from the onset part of the peak to the top of the peak was determined as glass transition temperature.

<Measurement of Loss Tangent (Tan δ) of Toner and Binder Resin>

The loss tangent (tan δ) was measured by a viscoelasticity measurement. In the present invention, the toner was formed into a shape using a die having a weight of 0.8 g, and a diameter of 20 mm at the pressure of 30 MPa. The resulting sample was subjected to the measurements of loss elastic modulus (G"), storage elastic modulus (G'), and loss tangent (tan δ) using a parallel corn having a diameter of 20 mm, by ADVANCED RHEOMETRIC EXPANSION SYSTEM manufactured by TA Instruments Japan Inc. at the frequency of 1.0 Hz, heating speed of 2.0° C./min, and distortion of 0.1% (automatic distortion control; acceptable minimum stress: 1.0 g/cm, acceptable maximum stress: 500 g/cm, maximum added distortion: 200%, distortion adjustment: 200%). In this case, the value of the loss tangent (tan δ) with which the storage elastic modulus (G') was 10 or less was excluded.

<Measurement of Acid Values of Toner and Binder Resin>

The measurement of the acid values of the toner and the binder resin were carried out in accordance with the measuring method specified in JIS K0070-1992 under the following conditions.

Preparation of Sample:

To 120 mL of toluene, 0.5 g of the toner or binder resin (0.3 g of the ethyl acetate soluble component) was added, and the mixture was stirred at room temperature for about 10 hours to dissolve the toner or binder resin. Ethanol (30 mL) was further added to the mixed solution, to thereby prepare a sample solution.

The measurement could be calculated by the above-described measuring device. Specifically, it was calculated in the following manner. The sample was titrated with a N/10 potassium hydroxide alcohol solution, which had been standardized in advance. The acid value was determined from the consumed amount of the potassium hydroxide alcohol solution using the following equation.

$$\text{Acid Value}=\text{KOH(number of mL)}\times N\times 56.1/\text{mass of sample}$$

(provided that N is a factor of N/10 KOH)

In the following examples and comparative examples, one type of the binder resin was used. Therefore, the acid value of the binder resin and the acid value of the toner were substantially matched. For this reason, the acid value of the binder was treated as the acid value of the toner.

<Measurement of Molecular Weight of Resin>

The number average molecular weight and weight average molecular weight of the toner was measured by measuring a molecular weight distribution of a THF soluble component by means of a gel permeation chromatography (GPC) measuring device GPC-150C (manufactured by WATERS).

The measurement was carried out in the following manner using columns (Shodex KF801 to 807, manufactured by Showa Denko K.K.). The columns were stabilized in a heat chamber of 40° C., and THF serving as a solvent was introduced into the columns heated to 40° C. at the follow rate of 1 mL/min. After sufficiently dissolving 0.05 g of a sample in 5 g of THF, the sample solution was filtered with a filter for a pretreatment (chromatodisc (manufactured by KURABO INDUSTRIES LTD.), pore diameter: 0.45 μm). The THF resin sample solution, in which the sample concentration was ultimately adjusted to 0.05% by mass to 0.6% by mass, was injected in an amount of 50 μL to 200 μL for the measurement. As for the measurement of the weight average molecular weight Mw and number average molecular weight Mn of the THF soluble component of the sample, the molecular weight distribution of the sample was calculated from the relationship between the logarithmic value of the calibration curve prepared from several monodisperse polystyrene standard samples and the number of counts.

As for the monodisperse polystyrene standard sample for creating a calibration curve, it was appropriate to use samples having the molecular weights of $6\times10^2$, $2.1\times10^2$, $4\times10^2$, $1.75\times10^4$, $5.1\times10^4$, $1.1\times10^5$, $3.9\times10^5$, $8.6\times10^5$, $2\times10^6$, $4.48\times10^6$ (of Pressure Chemical Co., or also of Tosoh Corporation) and use at least about 10 polystyrene standard samples. Accordingly, these samples were used. Moreover, a reflective index (RI) detector was used as a detector.

<Measurement of Melting Point of Wax>

A sample was weighed in an aluminium pan by 0.01 g to 0.02 g. By means of a differential scanning caloritometer (DSC210, manufactured by Seiko Instruments Inc.), the sample was heated to 150° C. at the heating rate of 10° C./min, to measure the maximum endothermic peak temperature. The maximum endothermic peak temperature was determined as a melting point.

[Production Example of Binder Resin]

[Production of Polyester Resin 1]

A 5 L autoclave equipped with a distillation column was charged with 4,000 g of a monomer mixture which was formulated to contain polyoxypropylene(2.2)-2,2-bis(4-hydroxyphenyl)propane (abbreviated as "BPA-PO" hereinafter) as an aromatic diol component, which was in an amount of 40 mol % in the alcohol component; ethylene glycol in an amount of 60 mol % in the alcohol component, adipic acid in an amount of 40 mol % in the carboxylic acid component, terephthalic acid in an amount of 20 mol % in the carboxylic acid component, isophthalic acid in an amount of 20 mol % in the carboxylic acid component, and trimellitic acid in an amount of 20 mol % in the carboxylic acid, based on a mass ratio. The monomer mixture was allowed to react through an esterification reaction under atmospheric pressure at 170° C. to 260° C. without a catalyst. Thereafter, 400 ppm of antimony trioxide relative to the total amount of the carboxylic acid was added to the reaction system, and the resulting mixture was allowed to react through a polycondensation reaction at 250° C. under a vacuumed condition of 3 Torr while removing glycol from the system, to thereby obtain Polyester Resin 1. Note that, the cross-linking reaction was carried out until the stirring torque reached 10 kg·cm (100 ppm), and the reaction was terminated by releasing the vacuum condition of the reaction system. The properties of Polyester Resin 1 are presented in Table 1.

[Production of Polyester Resin 2]

A 5 L autoclave equipped with a distillation column was charged with 4,000 g of a monomer mixture which was formulated to contain BPA-PO as an aromatic diol component, which was in an amount of 60 mol % in the alcohol component, ethylene glycol in an amount of 40 mol % in the alcohol component, adipic acid in an amount of 40 mol % in the carboxylic acid component, terephthalic acid in an amount of 20 mol % in the carboxylic acid component, isophthalic acid in an amount of 20 mol % in the carboxylic acid component, and trimellitic acid in an amount of 20 mol % in the carboxylic acid based on a mass ratio. The monomer mixture was allowed to react through an esterification reaction under atmospheric pressure at 170° C. to 260° C. without a catalyst. Thereafter, 400 ppm of antimony trioxide relative to the total amount of the carboxylic acid was added to the reaction system, and the resulting mixture was allowed to react through a polycondensation reaction at 250° C. under a vacuumed condition of 3 Torr while removing glycol from the system, to thereby obtain Polyester Resin 2. Note that, the cross-linking reaction was carried out until the stirring torque reached 10 kg·cm (100 ppm), and the reaction was terminated by releasing the vacuum condition of the reaction system. The properties of Polyester Resin 2 are presented in Table 1.

[Production of Polyester Resin 3]

A 5 L autoclave equipped with a distillation column was charged with 4,000 g of a monomer mixture which was formulated to contain BPA-PO as an aromatic diol component, which was in an amount of 80 mol % in the alcohol component, ethylene glycol in an amount of 20 mol % in the alcohol component, adipic acid in an amount of 40 mol % in the carboxylic acid component, terephthalic acid in an amount of 20 mol % in the carboxylic acid component, isophthalic acid in an amount of 20 mol % in the carboxylic acid component, and trimellitic acid in an amount of 20 mol % in the carboxylic acid based on a mass ratio. The monomer mixture was allowed to react through an esterification reaction under atmospheric pressure at 170° C. to 260° C. without a catalyst. Thereafter, 400 ppm of antimony trioxide relative to the total amount of the carboxylic acid was added to the reaction system, and the resulting mixture was allowed to react through a polycondensation reaction at 250° C. under a vacuumed condition of 3 Torr while removing glycol from the system, to thereby obtain Polyester. Resin 3. Note that, the cross-linking reaction was carried out until the stirring torque reached 10 kg·cm (100 ppm), and the reaction was terminated by releasing the vacuum condition of the reaction system. The properties of Polyester Resin 3 are presented in Table 1.

[Production of Polyester Resin 4]

A 5 L autoclave equipped with a distillation column was charged with 4,000 g of a monomer mixture which was formulated to contain BPA-PO as an aromatic diol component, which was in an amount of 60 mol % in the alcohol component, ethylene glycol in an amount of 20 mol % in the alcohol component, glycerin in an amount of 20 mol % in the alcohol component, adipic acid in an amount of 40 mol % in the carboxylic acid component, terephthalic acid in an amount of 20 mol % in the carboxylic acid component, isophthalic acid in an amount of 20 mol % in the carboxylic acid component, and trimellitic acid in an amount of 20 mol % in the carboxylic acid based on a mass ratio. The monomer mixture was allowed to react through an esterification reaction under atmospheric pressure at 170° C. to 260° C. without a catalyst. Thereafter, 400 ppm of antimony trioxide relative to the total amount of the carboxylic acid was added to the reaction system, and the resulting mixture was allowed to react through a polycondensation reaction at 250° C. under a vacuumed condition of 3 Torr while removing glycol from the system, to thereby obtain Polyester Resin 4. Note that, the cross-linking reaction was carried out until the stirring torque reached 10 kg·cm (100 ppm), and the reaction was terminated by releasing the vacuum condition of the reaction system. The properties of Polyester Resin 4 are presented in Table 1.

[Production of Polyester Resin 5]

A 5 L autoclave equipped with a distillation column was charged with 4,000 g of a monomer mixture which was formulated to contain BPA-PO as an aromatic diol component, which was in an amount of 25 mol % in the alcohol component, ethylene glycol in an amount of 75 mol % in the alcohol component, adipic acid in an amount of 40 mol % in the carboxylic acid component, terephthalic acid in an amount of 20 mol % in the carboxylic acid component, isophthalic acid in an amount of 20 mol % in the carboxylic acid component, and trimellitic acid in an amount of 20 mol % in the carboxylic acid based on a mass ratio. The monomer mixture was allowed to react through an esterification reaction under atmospheric pressure at 170° C. to 260° C. without a catalyst. Thereafter, 400 ppm of antimony trioxide relative to the total amount of the carboxylic acid was added to the reaction system, and the resulting mixture was allowed to react through a polycondensation reaction at 250° C. under a vacuumed condition of 3 Torr while removing glycol from the system, to thereby obtain Polyester Resin 5. Note that, the cross-linking reaction was carried out until the stirring torque reached 10 kg·cm (100 ppm), and the reaction was terminated by releasing the vacuum condition of the reaction system. The properties of Polyester Resin 5 are presented in Table 1.

[Production of Polyester Resin 6]

A 5 L autoclave equipped with a distillation column was charged with 4,000 g of a monomer mixture which was formulated to contain BPA-PO as an aromatic diol component, which was in an amount of 60 mol % in the alcohol component, polyoxyethylene(2.2)-2,2-bis(4-hydroxyphenyl)propane (abbreviated as "BPA-EO" hereinafter) as an aromatic diol component, which was in an amount of 20 mol % in the alcohol component, ethylene glycol in an amount of 20 mol % in the alcohol component, adipic acid in an amount of 40 mol % in the carboxylic acid component, terephthalic acid in an amount of 20 mol % in the carboxylic acid component, isophthalic acid in an amount of 20 mol % in the carboxylic acid component, and trimellitic acid in an amount of 20 mol % in the carboxylic acid based on a mass ratio. The monomer mixture was allowed to react through an esterification reaction under atmospheric pressure at 170° C. to 260° C. without a catalyst. Thereafter, 400 ppm of antimony trioxide relative to the total amount of the carboxylic acid was added to the reaction system, and the resulting mixture was allowed to react through a polycondensation reaction at 250° C. under a vacuumed condition of 3 Torr while removing glycol from the system, to thereby obtain Polyester Resin 6. Note that, the cross-linking reaction was carried out until the stirring torque reached 10 kg·cm (100 ppm), and the reaction was terminated by releasing the vacuum condition of the reaction system. The properties of Polyester Resin 6 are presented in Table 1.

[Production of Polyester Resin 7]

A 5 L autoclave equipped with a distillation column was charged with 4,000 g of a monomer mixture which was formulated to contain BPA-PO as an aromatic diol component, which was in an amount of 60 mol % in the alcohol component, ethylene glycol in an amount of 40 mol % in the alcohol component, adipic acid in an amount of 40 mol % in the carboxylic acid component, terephthalic acid in an amount of 10 mol % in the carboxylic acid component, isophthalic acid in an amount of 10 mol % in the carboxylic acid component, and trimellitic acid in an amount of 40 mol % in the carboxylic acid based on a mass ratio. The monomer mixture was allowed to react through an esterification reaction under atmospheric pressure at 170° C. to 260° C. without a catalyst. Thereafter, 400 ppm of antimony trioxide relative to the total amount of the carboxylic acid was added to the reaction system, and the resulting mixture was allowed to react through a polycondensation reaction at 250° C. under a vacuumed condition of 3 Torr while removing glycol from the system, to thereby obtain Polyester Resin 7. Note that, the cross-linking reaction was carried out until the stirring torque reached 10 kg·cm (100 ppm), and the reaction was terminated by releasing the vacuum condition of the reaction system. The properties of Polyester Resin 7 are presented in Table 1.

[Production of Polyester Resin 8]

A 5 L autoclave equipped with a distillation column was charged with 4,000 g of a monomer mixture which was formulated to contain BPA-PO as an aromatic diol component, which was in an amount of 40 mol % in the alcohol component, ethylene glycol in an amount of 20 mol % in the alcohol component, glycerin in an amount of 40 mol % in the alcohol component, adipic acid in an amount of 40 mol % in the carboxylic acid component, terephthalic acid in an amount of 20 mol % in the carboxylic acid component, isophthalic acid in an amount of 20 mol % in the carboxylic acid component, and trimellitic acid in an amount of 20 mol % in the carboxylic acid based on a mass ratio. The monomer mixture was allowed to react through an esterification reaction under atmospheric pressure at 170° C. to 260° C. without a catalyst. Thereafter, 400 ppm of antimony trioxide relative to the total amount of the carboxylic acid was added to the reaction system, and the resulting mixture was allowed to react through a polycondensation reaction at 250° C. under a vacuumed condition of 3 Torr while removing glycol from the system, to thereby obtain Polyester Resin 8. Note that, the cross-linking reaction was carried out until the stirring torque reached 10 kg·cm (100 ppm), and the reaction was terminated by releasing the vacuum condition of the reaction system. The properties of Polyester Resin 8 are presented in Table 1.

[Production of Polyester Resin 9]

A 5 L autoclave equipped with a distillation column was charged with 4,000 g of a monomer mixture which was formulated to contain BPA-PO as an aromatic diol component, which was in an amount of 40 mol % in the alcohol component, BPA-EO in an amount of 40 mol % in the alcohol component, glycerin in an amount of 20 mol % in the alcohol component, adipic acid in an amount of 40 mol % in the carboxylic acid component, terephthalic acid in an amount of 20 mol % in the carboxylic acid component, isophthalic acid in an amount of 20 mol % in the carboxylic acid component, and trimellitic acid in an amount of 20 mol % in the carboxylic acid based on a mass ratio. The monomer mixture was allowed to react through an esterification reaction under atmospheric pressure at 170° C. to 260° C. without a catalyst. Thereafter, 400 ppm of antimony trioxide relative to the total amount of the carboxylic acid was added to the reaction system, and the resulting mixture was allowed to react through a polycondensation reaction at 250° C. under a vacuumed condition of 3 Torr while removing glycol from the system, to thereby obtain Polyester Resin 9. Note that, the cross-linking reaction was carried out until the stirring torque reached 10 kg·cm (100 ppm), and the reaction was terminated by releasing the vacuum condition of the reaction system. The properties of Polyester Resin 9 are presented in Table 1.

TABLE 1

| Polyester resin No. | | 1 | 2 | 3 | 4 | 5 | 6 | 7 | 8 | 9 |
|---|---|---|---|---|---|---|---|---|---|---|
| Alcohol component | BPA-PO* (mol %) | 40 | 60 | 80 | 60 | 25 | 60 | 60 | 40 | 40 |
| | BPA-EO* (mol %) | | | | | | 20 | | | 40 |
| | Ethylene glycol (mol %) | 60 | 40 | 20 | 20 | 75 | 20 | 40 | 20 | |
| | Glycerin (mol %) | | | | 20 | | | | 40 | 20 |
| Carboxylic acid component | Adipic acid (mol %) | 40 | 40 | 40 | 40 | 40 | 40 | 40 | 40 | 40 |
| | Terephthalic acid (mol %) | 20 | 20 | 20 | 20 | 20 | 20 | 10 | 20 | 20 |
| | Isophthalic acid (mol %) | 20 | 20 | 20 | 20 | 20 | 20 | 10 | 20 | 20 |
| | Trimellitic acid (mol %) | 20 | 20 | 20 | 20 | 20 | 20 | 40 | 20 | 20 |
| Properties of polyester resin | Softening point (° C.) | 118 | 122 | 137 | 127 | 106 | 129 | 130 | 120 | 135 |
| | Glass transition temperature (° C.) | 58.9 | 61.6 | 67.2 | 64.2 | 54.5 | 65.1 | 66.9 | 60.8 | 66.3 |
| | Loss tangent peak temperature (° C.) | 99 | 108 | 113 | 110 | 94 | 117 | 113 | 97 | 115 |
| | Loss tangent value | 23 | 21 | 14 | 12 | 18 | 15 | 11 | 15 | 6 |
| | Acid value (mg/KOH/g) | 9.6 | 10.8 | 11.8 | 6.4 | 11.3 | 10.6 | 13.2 | 4.2 | 11.5 |
| | Mw | 7,220 | 8,320 | 9,980 | 8,030 | 6,650 | 10,090 | 8,250 | 7,750 | 9,940 |
| | Mn | 2,490 | 2,540 | 2,820 | 2,370 | 2,430 | 2,780 | 2,420 | 2,420 | 2,850 |
| | Mw/Mn | 2.9 | 3.3 | 3.5 | 3.4 | 2.7 | 3.6 | 3.4 | 3.2 | 3.5 |

*BPA-PO: polyoxypropylene(2.2)-2,2-bis(4-hydroxyphenyl)propane
*BPA-EO: polyoxyethylene(2.2)-2,2-bis(4-hydroxyphenyl)propane In the formulation Nos. 1 to 10, the materials were blended in the manner that the molar number of the alcohol component and the molar number of the carboxylic acid component satisfied the molar ratio of 100:100.

[Production Example of Binder Resin: Production of Polyol Resin 1]

A separable flask equipped with a stirrer, a thermometer, a nitrogen inlet tube, and a cooling tube was charged with 1,000 g of a low-molecular weight bisphenol A epoxy resin (number average molecular weight: about 1,000), 50 g of terephthalic acid, 5 g of benzoic acid, and 300 g of xylene. In the nitrogen atmosphere, the resulting mixture was heated to the temperature of 70° C. to 100° C., followed by adding 0.183 g of lithium chloride to the mixture. The resultant was further heated to 160° C., and xylene was removed under the reduced pressure. Then, the mixture was polymerized at the reaction temperature of 180° C. for 4 hours to 6 hours, to thereby obtain Polyol Resin 1. The glass transition temperature of Polyol Resin 1 was 61.4° C., the loss tangent peak temperature (° C.) thereof was 142° C., the loss tangent value thereof was 25, the acid value thereof was 11.5 mgKOH/g, the weight average molecular weight (Mw)

thereof was 9,500, the number average molecular weight (Mn) thereof was 2,750, and the ratio Mw/Mn was 3.5.

[Production Example of Monoester Wax]

[Production of Monoester Wax 1]

A 1 L four-necked flask equipped with a thermometer, a nitrogen inlet tube, a stirrer, and a cooling tube was charged with a fatty acid component (50 mol % of cerotic acid, and 50 mol % of palmitic acid), and an alcohol component (100 mol % of ceryl alcohol) in a manner that a molar ratio of the fatty acid component to the alcohol component was 100:100, and a total weight was 500 g. The mixture was allowed to react for 15 hours or longer under atmospheric pressure under a nitrogen gas flow at 220° C. with removing the reaction product, to thereby obtain Monoester Wax 1. The melting point of Monoester Wax 1 is presented in Table 2.

[Production of Monoester Wax 2]

A 1 L four-necked flask equipped with a thermometer, a nitrogen inlet tube, a stirrer, and a cooling tube was charged with a fatty acid component (10 mol % of cerotic acid, and 90 mol % of palmitic acid), and an alcohol component (100 mol % of ceryl alcohol) in a manner that a molar ratio of the fatty acid component to the alcohol component was 100:100, and a total weight was 500 g. The mixture was allowed to react for 15 hours or longer under atmospheric pressure under a nitrogen gas flow at 220° C. with removing the reaction product, to thereby obtain Monoester Wax 2. The melting point of Monoester Wax 2 is presented in Table 2.

TABLE 2

| | | Monoester wax No. | |
|---|---|---|---|
| | | 1 | 2 |
| Saturated fatty acid component | Cerotic acid | 50 | 10 |
| | Palmitic acid | 50 | 90 |
| Alcohol component | Ceryl alcohol | 100 | 100 |
| Properties of monoester wax | Melting point (° C.) | 71 | 64 |

Example 1: Production of Clear Toner 1

| | |
|---|---|
| Polyester Resin 1 | 93 parts |
| Monoester Wax 1 | 6 parts |
| Zirconium salt of salicylic acid derivative | 1 part |

As for the zirconium salt of the salicylic acid derivative, the compound represented by the following structural formula (1) was used.

Structural Formula (1)

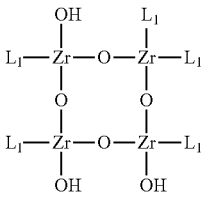

In the structural formula (1), $L_1$ denotes the following structure.

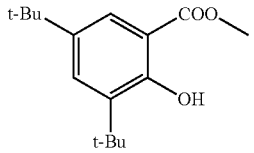

In the structural formula above, "t-Bu" denotes a t-butyl group.

After previously mix the above-listed toner raw materials by means of HENSCHEL MIXER (FM20B, manufactured by NIPPON COLE & ENGINEERING CO., LTD.), the mixture was melted and kneaded at the temperature of 100° C. to 130° C. by means of a single-screw kneader (co-kneader, manufactured by Buss Compounding Systems AG). The obtained kneaded product was cooled to room temperature, followed by roughly pulverizing the kneaded product into 200 μm to 300 μm by means of Rotoplex. Subsequently, the resultant was finely pulverized by means of counter jet mill (100AFG, manufactured by Hosokawa Micron Corporation) to give the weight average particle diameter of 6.2 μm±0.3 μm with appropriately adjusting pulverization air, followed by classifying the particles by means of an air classifier (EJ-LABO, manufactured by MATSUBO Corporation) with appropriately adjusting an opening of a louver to give the weight average particle diameter of 7.0 μm±0.2 μm, and a ratio Mw/Mn of 1.20 or less, to thereby obtain toner base particles. Subsequently, 1.0 part of an additive (HDK-2000, manufactured by Clariant K.K.) and 1.0 part of an additive (H05TD, manufactured by Clariant K.K.) were added to 100 parts of the toner base particles, and the resulting mixture was stirred and mixed by means of HENSCHEL MIXER, to thereby produce Clear Toner 1.

Example 2: Production of Clear Toner 2

| | |
|---|---|
| Polyester Resin 2 | 93 parts |
| Monoester Wax 1 | 6 parts |
| Zirconium salt of salicylic acid derivative (structural formula (1)) | 1 part |

Clear Toner 2 was produced in the same manner as Clear Toner 1, provided that the above-listed toner raw materials were used.

Example 3: Production of Clear Toner 3

| | |
|---|---|
| Polyester Resin 3 | 93 parts |
| Monoester Wax 1 | 6 parts |
| Zirconium salt of salicylic acid derivative (structural formula (1)) | 1 part |

Clear Toner 3 was produced in the same manner as Clear Toner 1, provided that the above-listed toner raw materials were used.

Example 4: Production of Clear Toner 4

| | |
|---|---|
| Polyester Resin 4 | 93 parts |
| Monoester Wax 1 | 6 parts |
| Zirconium salt of salicylic acid derivative (structural formula (1)) | 1 part |

Clear Toner 4 was produced in the same manner as Clear Toner 1, provided that the above-listed toner raw materials were used. [Example 5: Production of Clear Toner 5]

| | |
|---|---|
| Polyester Resin 2 | 93 parts |
| Monoester Wax 1 | 6 parts |
| Aluminium salt of salicylic acid derivative | 1 part |

As for the aluminium salt of the salicylic acid derivative, the compound represented by the following structural formula (2) was used.

Structural Formula (2)

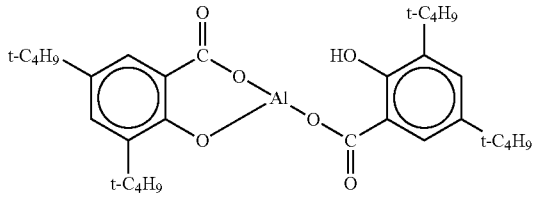

Clear Toner 5 was produced in the same manner as Clear Toner 1, provided that the above-listed toner raw materials were used.

Example 6: Production of Clear Toner 6

| | |
|---|---|
| Polyester Resin 2 | 93 parts |
| Monoester Wax 2 | 6 parts |
| Aluminium salt of salicylic acid derivative (structural formula (2)) | 1 part |

Clear Toner 6 was produced in the same manner as Clear Toner 1, provided that the above-listed toner raw materials were used.

Example 7: Production of Clear Toner 7

| | |
|---|---|
| Polyester Resin 2 | 93 parts |
| Carnauba wax (manufactured by CERARICA NODA Co., Ltd., melting point: 84° C.) | 6 parts |
| Zirconium salt of salicylic acid derivative (structural formula (1)) | 1 part |

Clear Toner 7 was produced in the same manner as Clear Toner 1, provided that the above-listed toner raw materials were used.

Example 8: Production of Clear Toner 8

| | |
|---|---|
| Polyester Resin 2 | 93 parts |
| Microcrystalline wax (Hi-Mic-1080, manufactured by NIPPON SEIRO CO., LTD., melting point: 83° C.) | 6 parts |
| Zirconium salt of salicylic acid derivative (structural formula (1)) | 1 part |

Clear Toner 8 was produced in the same manner as Clear Toner 1, provided that the above-listed toner raw materials were used.

Example 9: Production of Clear Toner 9

| | |
|---|---|
| Polyester Resin 8 | 93 parts |
| Monoester Wax 1 | 6 parts |
| Zirconium salt of salicylic acid derivative (structural formula (1)) | 1 part |

Clear Toner 9 was produced in the same manner as Clear Toner 1, provided that the above-listed toner raw materials were used.

Example 10: Production of Clear Toner 10

| | |
|---|---|
| Polyester Resin 7 | 93 parts |
| Monoester Wax 1 | 6 parts |
| Zirconium salt of salicylic acid derivative (structural formula (1)) | 1 part |

Clear Toner 10 was produced in the same manner as Clear Toner 1, provided that the above-listed toner raw materials were used.

Example 11: Production of Clear Toner 11

| | |
|---|---|
| Polyester Resin 2 | 90 parts |
| Monoester Wax 1 | 6 parts |
| Zirconium salt of salicylic acid derivative (structural formula (1)) | 1 part |
| Acrylonitrile-butyl acrylate-styrene copolymer | 3 parts |

Clear Toner 11 was produced in the same manner as Clear Toner 1, provided that the above-listed toner raw materials were used.

Example 12: Production of Clear Toner 12

| | |
|---|---|
| Polyester Resin 2 | 88 parts |
| Monoester Wax 1 | 6 parts |
| Zirconium salt of salicylic acid derivative (structural formula (1)) | 1 part |
| Acrylonitrile-butyl acrylate polyethylene adduct-styrene copolymer | 5 parts |

Clear Toner 12 was produced in the same manner as Clear Toner 1, provided that the above-listed toner raw materials were used.

[Production Example of Master Batch]

By means of HENSCHEL MIXER (manufactured by NIPPON COLE & ENGINEERING CO., LTD.), 50 parts of carbon black (REGAL 400R, manufactured by Cabot Corporation), 250 parts of Polyester Resin 1, and 30 parts of water were mixed. The mixture was kneaded at 160° C. for 50 minutes by means of two rolls, followed by rolled and cooled. The resultant was pulverized by means of a pulverizer to thereby obtain a black master batch.

A magenta master batch, cyan master batch, and yellow master batch were each produced in the same manner, provided that the carbon black was replaced with C.I. Pigment Red 269, C.I. Pigment Blue 15:3, or C.I. Pigment Yellow 155.

Example 13: Production of Black Toner 1

| | |
|---|---|
| Polyester Resin 2 | 72 parts |
| Monoester Wax 1 | 6 parts |
| Zirconium salt of salicylic acid derivative (structural formula (1)) | 1 part |
| Acrylonitrile-butyl acrylate-styrene copolymer | 5 parts |
| Black master batch | 16 parts |

Black Toner 1 was produced in the same manner as Clear Toner 1, provided that the above-listed toner raw materials were used.

Example 14: Production of Magenta Toner 1

| | |
|---|---|
| Polyester Resin 2 | 72 parts |
| Monoester Wax 1 | 6 parts |
| Zirconium salt of salicylic acid derivative (structural formula (1)) | 1 part |
| Acrylonitrile-butyl acrylate-styrene copolymer | 5 parts |
| Magenta master batch | 16 parts |

Magenta Toner 1 was produced in the same manner as Clear Toner 1, provided that the above-listed toner raw materials were used.

Example 15: Production of Cyan Toner 1

| | |
|---|---|
| Polyester Resin 2 | 72 parts |
| Monoester Wax 1 | 6 parts |
| Zirconium salt of salicylic acid derivative (structural formula (1)) | 1 part |
| Acrylonitrile-butyl acrylate-styrene copolymer | 5 parts |
| Cyan master batch | 16 parts |

Cyan Toner 1 was produced in the same manner as Clear Toner 1, provided that the above-listed toner raw materials were used.

Example 16: Production of Yellow Toner 1

| | |
|---|---|
| Polyester Resin 2 | 72 parts |
| Monoester Wax 1 | 6 parts |
| Zirconium salt of salicylic acid derivative (structural formula (1)) | 1 part |

-continued

| | |
|---|---|
| Acrylonitrile-butyl acrylate-styrene copolymer | 5 parts |
| Yellow master batch | 16 parts |

Yellow Toner 1 was produced in the same manner as Clear Toner 1, provided that the above-listed toner raw materials were used.

Comparative Example 1: Production of Clear Toner 13

| | |
|---|---|
| Polyester Resin 5 | 93 parts |
| Monoester Wax 1 | 6 parts |
| Zirconium salt of salicylic acid derivative (structural formula (1)) | 1 part |

Clear Toner 13 was produced in the same manner as Clear Toner 1, provided that the above-listed toner raw materials were used.

Comparative Example 2: Production of Clear Toner 14

| | |
|---|---|
| Polyester Resin 6 | 93 parts |
| Monoester Wax 1 | 6 parts |
| Zirconium salt of salicylic acid derivative (structural formula (1)) | 1 part |

Clear Toner 14 was produced in the same manner as Clear Toner 1, provided that the above-listed toner raw materials were used.

Comparative Example 3: Production of Clear Toner 15

| | |
|---|---|
| Polyol resin | 93 parts |
| Monoester Wax 1 | 6 parts |
| Zirconium salt of salicylic acid derivative (structural formula (1)) | 1 part |

Clear Toner 15 was produced in the same manner as Clear Toner 1, provided that the above-listed toner raw materials were used.

Comparative Example 4: Production of Clear Toner 16

| | |
|---|---|
| Polyester Resin 2 | 93 parts |
| Monoester Wax 1 | 6 parts |
| Metal salt of salicylic acid derivative (BONTRON E-84, manufactured by ORIENT CHEMICAL INDUSTRIES CO., LTD.) | 1 part |

Clear Toner 16 was produced in the same manner as Clear Toner 1, provided that the above-listed toner raw materials were used.

Comparative Example 5: Production of Clear Toner 17

| | |
|---|---|
| Polyester Resin 2 | 94 parts |
| Monoester Wax 1 | 6 parts |

Clear Toner 17 was produced in the same manner as Clear Toner 1, provided that the above-listed toner raw materials were used.

Comparative Example 6: Production of Clear Toner 18

| | |
|---|---|
| Polyester Resin 9 | 93 parts |
| Monoester Wax 1 | 6 parts |
| Zirconium salt of salicylic acid derivative (structural formula (1)) | 1 part |

Clear Toner 18 was produced in the same manner as Clear Toner 1, provided that the above-listed toner raw materials were used.

The loss tangent peak temperature (° C.), the maximum loss tangent peak temperature (° C.), and the maximum loss tangent value of the toner at 60° C. to 80° C., and the raw materials used are presented in Tables 3-1-1 to 3-2-2.

TABLE 3-1-1

| | Toner | | | |
|---|---|---|---|---|
| | Type | Max. loss tangent temperature (° C.) | Max. loss tangent value | Acid value (mgKOH/g)) |
| Ex. 1 | Clear Toner 1 | 97 | 21 | 9.5 |
| Ex. 2 | Clear Toner 2 | 105 | 18 | 10.5 |
| Ex. 3 | Clear Toner 3 | 113 | 13 | 11.6 |
| Ex. 4 | Clear Toner 4 | 111 | 9 | 6.2 |
| Ex. 5 | Clear Toner 5 | 102 | 17 | 10.3 |
| Ex. 6 | Clear Toner 6 | 106 | 20 | 10.6 |
| Ex. 7 | Clear Toner 7 | 108 | 15 | 11.2 |
| Ex. 8 | Clear Toner 8 | 107 | 18 | 10.9 |
| Ex. 9 | Clear Toner 9 | 96 | 14 | 4.3 |
| Ex. 10 | Clear Toner 10 | 114 | 10 | 13.1 |
| Ex. 11 | Clear Toner 11 | 111 | 15 | 10.4 |
| Ex. 12 | Clear Toner 12 | 115 | 12 | 10.5 |
| Ex. 13 | Black toner | 112 | 11 | 10.4 |
| Ex. 14 | Magenta toner | 111 | 12 | 10.1 |
| Ex. 15 | Cyan toner | 110 | 12 | 10.5 |
| Ex. 16 | Yellow toner | 110 | 13 | 10.2 |

TABLE 3-1-2

| | Binder resin Type | Wax Type | Metal salt Type | Wax dispersing agent Type |
|---|---|---|---|---|
| Ex. 1 | Polyester Resin 1 | Monoester Wax 1 | Zr salt of salicylic acid derivative | — |
| Ex. 2 | Polyester Resin 2 | Monoester Wax 1 | Zr salt of salicylic acid derivative | — |
| Ex. 3 | Polyester Resin 3 | Monoester Wax 1 | Zr salt of salicylic acid derivative | — |
| Ex. 4 | Polyester Resin 4 | Monoester Wax 1 | Zr salt of salicylic acid derivative | — |
| Ex. 5 | Polyester Resin 2 | Monoester Wax 1 | Al salt of salicylic acid derivative | — |
| Ex. 6 | Polyester Resin 2 | Monoester Wax 2 | Zr salt of salicylic acid derivative | — |

TABLE 3-1-2-continued

| | Binder resin Type | Wax Type | Metal salt Type | Wax dispersing agent Type |
|---|---|---|---|---|
| Ex. 7 | Polyester Resin 2 | Carnauba wax | Zr salt of salicylic acid derivative | — |
| Ex. 8 | Polyester Resin 2 | Microcrystalline wax | Zr salt of salicylic acid derivative | — |
| Ex. 9 | Polyester Resin 8 | Monoester Wax 1 | Zr salt of salicylic acid derivative | — |
| Ex. 10 | Polyester Resin 7 | Monoester Wax 1 | Zr salt of salicylic acid derivative | — |
| Ex. 11 | Polyester Resin 2 | Monoester Wax 1 | Zr salt of salicylic acid derivative | Acrylonitrile-butylacrylate-styrene copolymer |
| Ex. 12 | Polyester Resin 2 | Monoester Wax 1 | Zr salt of salicylic acid derivative | Acrylonitrile-butylacrylate polyethylene adduct-styrene copolymer |
| Ex. 13 | Polyester Resin 2 | Monoester Wax 1 | Zr salt of salicylic acid derivative | Acrylonitrile-butylacrylate-styrene copolymer |
| Ex. 14 | Polyester Resin 2 | Monoester Wax 1 | Zr salt of salicylic acid derivative | Acrylonitrile-butylacrylate-styrene copolymer |
| Ex. 15 | Polyester Resin 2 | Monoester Wax 1 | Zr salt of salicylic acid derivative | Acrylonitrile-butylacrylate-styrene copolymer |
| Ex. 16 | Polyester Resin 2 | Monoester Wax 1 | Zr salt of salicylic acid derivative | Acrylonitrile-butylacrylate-styrene copolymer |

TABLE 3-2-1

| | Toner | | | |
|---|---|---|---|---|
| | Type | Max. loss tangent temperature (° C.) | Max. loss tangent value | Acid value (mgKOH/g)) |
| Comp. Ex. 1 | Clear Toner 13 | 92 | 15 | 10.9 |
| Comp. Ex. 2 | Clear Toner 14 | 118 | 12 | 10.4 |
| Comp. Ex. 3 | Clear Toner 15 | 100 | 22 | 11.2 |
| Comp. Ex. 4 | Clear Toner 16 | 104 | 20 | 10.4 |
| Comp. Ex. 5 | Clear Toner 17 | 103 | 22 | 10.9 |
| Comp. Ex. 6 | Clear Toner 18 | 117 | 7 | 11.2 |

TABLE 3-2-2

| | Binder resin Type | Wax Type | Metal salt Type | Wax dispersing agent Type |
|---|---|---|---|---|
| Comp. Ex. 1 | Polyester Resin 5 | Monoester Wax 1 | Zr salt of salicylic acid derivative | — |
| Comp. Ex. 2 | Polyester Resin 6 | Monoester Wax 1 | Zr salt of salicylic acid derivative | — |
| Comp. Ex. 3 | Polyol resin | Monoester Wax 1 | Zr salt of salicylic acid derivative | — |
| Comp. Ex. 4 | Polyester Resin 2 | Monoester Wax 1 | BONTRON E-84 | — |
| Comp. Ex. 5 | Polyester Resin 2 | Monoester Wax 1 | — | — |

TABLE 3-2-2-continued

| | Binder resin Type | Wax Type | Metal salt Type | Wax dispersing agent Type |
|---|---|---|---|---|
| Comp. Ex. 6 | Polyester Resin 9 | Monoester Wax 1 | Zr salt of salicylic acid derivative | — |

[Production of Two-Component Developer]

<Production of Carrier A>

| | |
|---|---|
| Silicone resin (organo straight silicone) | 100 parts |
| Toluene | 100 parts |
| γ-(2-aminoethyl)aminopropyltrimethoxysilane | 5 parts |
| Carbon black | 10 parts |

The mixture of the above-listed materials was dispersed for 20 minutes by means of a homomixer, to thereby prepare a coating layer forming liquid. This coating layer forming liquid was applied on a core material, which was Mn ferrite particles having the weight average particle diameter of 35 μm, by means of a fluid-bed coating device, to give the average film thickness of 0.20 μm on the surface of the core material, and was then dried by adjusting the temperature of the fluid tank to 70° C.

The obtained carrier was baked in an electric furnace at 180° C. for 2 hours, to thereby obtain Carrier A.

<Production of Two-Component Developer>

The produced clear toner or color toner, and Carrier A were homogeneously mixed for 5 minutes at 48 rpm by means of TURBULA mixer (manufactured by Willy A. Bachofen (WAB) AG Maschinenfabrik), to thereby produce a two-component developer. Note that, a blending ratio of the toner and the carrier was adjusting by blending the toner and the carrier to match the toner density (4% by mass) in the initial developer of the evaluation device.

[Evaluation 1]

The following evaluations were performed using two-component developers prepared by using Clear Toners 1 to 18, the black toner, the magenta toner, the cyan toner, and the yellow toner produced in Examples and Comparative Examples above.

<Glossiness>

By means of a modified device (linear velocity: 280 mm/sec) of a digital full-color multifunction peripheral Imagio Neo C600 (manufactured by Ricoh Company Limited), a solid image having a side of 4 cm was formed with each of the developers to give a deposition amount of 0.65 mg/cm$^2$, followed by fixing the image at the fixing temperature of 200° C., and the nip width of 10 mm. Then, glossiness of the resulting image was measured.

For the evaluation, coated glossy paper (135 g/m$^2$) manufactured by Mondi was used as a sheet. The gloss was evaluated by measuring 60 degrees glossiness by means of a gloss meter VGS-1D, manufactured by NIPPON DENSHOKU INDUSTRIES CO., LTD. at 10 points on the image.

[Evaluation Criteria]

A: 85 or greater

B: 80 or greater but less than 85

C: 75 or greater but less than 80

D: less than 75

<Glossiness Width>

By means of a modified device (linear velocity: 280 mm/sec) of a digital full-color multifunction peripheral Imagio Neo C600 (manufactured by Ricoh Company Limited), a solid image having a side of 4 cm was formed with each of the developers to give a deposition amount of 0.65 mg/cm$^2$, followed by fixing the image at the fixing temperature in the range of 180° C. to 220° C., and the nip width of 10 mm. Then, glossiness of the resulting image was measured.

For the evaluation, coated glossy paper (135 g/m$^2$) manufactured by Mondi was used as a sheet. As for the gloss, 60 degrees glossiness was measured by means of a gloss meter VGS-1D, manufactured by NIPPON DENSHOKU INDUSTRIES CO., LTD. at 10 points on the image. The temperature range in which the value of the glossiness was 75 or greater was evaluated.

[Evaluation Criteria]

A: 40° C. or higher

B: 30° C. or higher but lower than 40° C.

C: 25° C. or higher but lower than 30° C.

D: lower than 25° C.

<Low Temperature Fixing Ability>

By means of a modified device (linear velocity: 280 mm/sec) of a digital full-color multifunction peripheral Imagio Neo C600 (manufactured by Ricoh Company Limited), a solid image having a side of 4 cm was formed with each of the developers to give a deposition amount of 0.85 mg/cm$^2$, followed by fixing the image at the fixing nip width of 10 mm with varying the fixing roller temperature. A presence of the cold offset was visually observed, and the lowest temperature at which the cold offset did not occur was determined as the minimum fixing temperature. The low temperature fixing ability was evaluated based on the following criteria.

For the evaluation, PPC paper TYPE6000 (70 W) manufactured by Ricoh Company Limited was used as a sheet.

[Evaluation Criteria]

A: The minimum fixing temperature was lower than 140° C.

B: The minimum fixing temperature was 140° C. or higher but lower than 145° C.

C: The minimum fixing temperature was 145° C. or higher but lower than 150° C.

D: The minimum fixing temperature was 150° C. or higher.

<Hot Offset Resistance>

By means of a modified device (linear velocity: 280 mm/sec) of a digital full-color multifunction peripheral Imagio Neo C600 (manufactured by Ricoh Company Limited), a solid image having a side of 4 cm was formed with each of the developers to give a deposition amount of 0.85 mg/cm$^2$, followed by fixing the image at the fixing nip width of 10 mm with varying the fixing roller temperature. A presence of the hot offset was visually observed, and the highest temperature at which the hot offset did not occur was determined as the maximum fixing temperature. The hot offset resistance was evaluated based on the following criteria.

For the evaluation, PPC paper TYPE6000 (70 W) manufactured by Ricoh Company Limited was used as a sheet.

[Evaluation Criteria]

A: The maximum fixing temperature was 185° C. or higher.

B: The maximum fixing temperature was 175° C. or higher but lower than 185° C.

C: The maximum fixing temperature was 170° C. or higher but lower than 175° C.

D: The maximum fixing temperature was lower than 170° C.

<Heat Resistant Storage Stability>

The storage stability of the toner was measured by means of a penetration testing device (manufactured by NIKKA Engineering Co., Ltd.).

Specifically, each toner was weighed by 10 g, and a 30 mL glass container (screw vial) was charged with the toner in the environment of 20° C. to 25° C., and 40% RH to 60% RH followed by closing a lid. After tapping the glass container charged with the toner 100 times, the toner in the glass container was left to stand for 24 hours in a thermostat the temperature of which was set to 50° C. Thereafter, the penetration degree of the toner was measured by means of the penetration testing device, and heat resistant storage stability of the toner was evaluated based on the following evaluation criteria.

The larger the value of the penetration degree is, more excellent the storage stability is.

[Evaluation Criteria]

A: The penetration degree was 30 mm or greater.

B: The penetration degree was 25 mm or greater but less than 30 mm.

C: The penetration degree was 20 mm or greater but less than 25 mm.

D: The penetration degree was less than 20 mm.

<Filming>

A modified device (linear velocity: 280 mm/sec) of a digital full-color multifunction peripheral Imagio Neo C600 (manufactured by Ricoh Company Limited) was charged with each of the developer, a continuous running test was performed at the printing ratio that was an image occupying ratio of 7% using PPC paper TYPE6000 (70 W) manufactured by Ricoh Company Limited. An occurrence of filming on the photoconductor and a presence of a defected image (unevenness of a half-tone density) due to filming was evaluated after printing of 20,000 sheets, 50,000 sheets, and 100,000 sheets. The filming tends to occur as the number of the sheets running increases.

[Evaluation Criteria]

I: The filming did not occur after printing of 100,000 sheets.

II The filming occurred after printing of more than 10,000 sheets but less than 100,000 sheets.

III: The filming occurred after printing of 10,000 sheets or less.

The evaluation results are presented in Table 4.

TABLE 4

| | Toner | Glossiness | Glossiness width | Low temperature fixing ability | Hot offset resistance | Heat storage stability | Filming |
|---|---|---|---|---|---|---|---|
| Ex. 1 | Clear Toner 1 | B | A | A | C | B | I |
| Ex. 2 | Clear Toner 2 | A | A | B | B | B | I |
| Ex. 3 | Clear Toner 3 | B | B | C | A | B | I |
| Ex. 4 | Clear Toner 4 | B | B | B | B | B | I |
| Ex. 5 | Clear Toner 5 | A | B | B | C | C | I |
| Ex. 6 | Clear Toner 6 | A | A | A | C | C | I |
| Ex. 7 | Clear Toner 7 | A | A | C | B | B | I |
| Ex. 8 | Clear Toner 8 | A | B | B | C | C | I |
| Ex. 9 | Clear Toner 9 | A | C | B | C | C | I |
| Ex. 10 | Clear Toner 10 | B | B | C | B | C | II |
| Ex. 11 | Clear Toner 11 | B | B | C | B | C | I |
| Ex. 12 | Clear Toner 12 | B | B | C | B | C | II |
| Ex. 13 | Black Toner | C | C | B | B | B | I |
| Ex. 14 | Magenta Toner | C | C | B | B | B | I |
| Ex. 15 | Cyan Toner | C | C | B | B | B | I |
| Ex. 16 | Yellow Toner | C | C | B | B | B | I |
| Comp. Ex. 1 | Clear Toner 13 | B | A | A | D | D | III |
| Comp. Ex. 2 | Clear Toner 14 | B | D | D | A | A | I |
| Comp. Ex. 3 | Clear Toner 15 | C | D | D | B | C | II |
| Comp. Ex. 4 | Clear Toner 16 | B | C | B | D | C | II |
| Comp. Ex. 5 | Clear Toner 17 | B | C | B | D | C | II |
| Comp. Ex. 6 | Clear Toner 18 | B | D | C | B | B | II |

Example 17

An image was formed with Clear Toner 12 and a commercial black toner (Toner Black for Imagio Neo C600, manufactured by Ricoh Company Limited) in accordance with the image forming method 1, to thereby obtain a fixed image.

Example 18

An image was formed with Clear Toner 12 and a commercial black toner (Toner Black for Imagio Neo C600, manufactured by Ricoh Company Limited) in accordance with the image forming method 2, to thereby obtain a fixed image.

[Evaluation 2]

<Glossiness>

A solid image having a side of 4 cm was formed in a manner that a solid image of the black toner having a deposition amount of 0.4 mg/cm$^2$ was superimposed on a solid image of the clear toner having a deposition amount of 0.4 mg/cm$^2$, followed by fixing the image at the fixing temperature of 200° C., and the nip width of 10 mm. Then, glossiness of the fixed image was measured.

For the evaluation, coated glossy paper (135 g/m$^2$) manufactured by Mondi was used as a sheet. The gloss was evaluated by measuring 60 degrees glossiness by means of a gloss meter VGS-1D, manufactured by NIPPON DENSHOKU INDUSTRIES CO., LTD. at 10 points on the image.

[Evaluation Criteria]

A: 85 or greater

B: 80 or greater but less than 85

C: 75 or greater but less than 80

D: less than 75

The evaluation results are presented in Table 5.

TABLE 5

| | Image formation method | Glossiness of clear toner part | Glossiness of black toner part |
|---|---|---|---|
| Ex. 17 | 1 | B | D |
| Ex. 18 | 2 | B | D |

REFERENCE SIGNS LIST

14: image processing unit (IPU)
15: writing unit
16: paper feeding unit
21: photoconductor drum
22: photoconductor drum
23: photoconductor drum
24: photoconductor drum
25: photoconductor drum
31: developing unit
32: developing unit
33: developing unit
34: developing unit
35: developing unit
41: cleaning unit
42: cleaning unit
43: cleaning unit
44: cleaning unit
45: cleaning unit
51: charging unit
52: charging unit
53: charging unit
54: charging unit
55: charging unit
61: transfer charge
62: transfer charge
63: transfer charge
64: transfer charge
65: transfer charge
66: secondary transfer unit
70: transfer belt
80: fixing unit

The invention claimed is:

1. A clear toner for electrophotography, comprising a toner in a form of a particle free from a colorant and containing:

a binder resin comprising a polyester resin;

a release agent comprising a monoester wax; and a metal salt of formula (1):

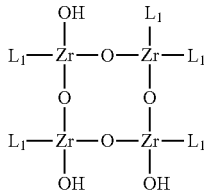

(1)

wherein $L_1$ denotes:

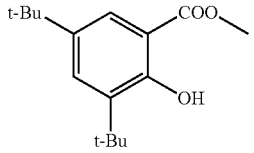

wherein t-Bu denotes a t-butyl group, wherein an acid value of the clear toner is 6 mgKOH/g to 12 mgKOH/g, wherein the polyester resin has a weight average molecular weight (Mw) from 7,000 to 10,000, wherein a ratio (Mw/Mn) of the weight average molecular weight (Mw) to the number average molecular weight (Mn) of the polyester resin is 4 or less, wherein the polyester resin has an acid value from 4.2 mgKOH/g to 13.2 mgKOH/g, and wherein a maximum value of loss tangent of the toner at 97° C. to 113° C. is from 9 to 21, as a viscoelasticity of the clear toner is measured, where the loss tangent is represented by the following formula:

Loss tangent (tan δ)=loss elastic modulus ($G''$)/storage elastic modulus ($G'$).

2. The clear toner according to claim 1, further comprising:

a wax-dispersing agent, which is a copolymer resin comprising at least styrene, butyl acrylate, and acrylonitrile as monomers.

3. The clear toner according to claim 1, wherein the binder resin comprises 50 mass % or more, based on a total mass of the binder resin, of the polyester.

4. The clear toner according to claim 3, comprising:

from 4 to 8 parts, relative to 100 parts of the clear toner, of the release agent; and from 0.5 to 2 parts, relative to 100 parts of the clear toner, of the metal salt.

5. An image forming method, comprising:

superimposing a color toner and the clear toner according to claim 1 to form an image; and simultaneously fixing the image, in which the color toner and the clear toner are superimposed, on a recording medium.

6. The image forming method according to claim 5, wherein a difference in glossiness between the color toner and the clear toner is 30 or greater.

7. A process cartridge, comprising:

an image bearer; and a developing device configured to develop an electrostatic latent image formed on the image bearer with a developer containing a clear toner and a carrier to form a visible image, wherein the image bearer and the developing device are integratedly supported, and the process cartridge is detachably mounted in a main body of an image forming apparatus, and wherein the clear toner is the clear toner according to claim 1.

* * * * *